US010156421B2

(12) United States Patent
Smith et al.

(10) Patent No.: US 10,156,421 B2
(45) Date of Patent: Dec. 18, 2018

(54) ADJUSTABLE LENGTH BI-DIRECTIONAL FOLDING STOCK FOR FIREARM

(71) Applicant: Vista Outdoor Operations LLC, Farmington, UT (US)

(72) Inventors: Paul N. Smith, Bozeman, MT (US); Robert A. Kincaid, Manhattan, MT (US); Daniel D. Sereday, Belgrade, MT (US); Troy E. Lance, Livingston, MT (US); Christopher J. Michael, Belgrade, MT (US); Oscar C. Woods, Bozeman, MT (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/638,862

(22) Filed: Jun. 30, 2017

(65) Prior Publication Data

US 2018/0023918 A1 Jan. 25, 2018

Related U.S. Application Data

(60) Provisional application No. 62/357,753, filed on Jul. 1, 2016.

(51) Int. Cl.

| | |
|---|---|
| ***F41C 23/04*** | (2006.01) |
| ***F41C 23/14*** | (2006.01) |
| ***F41C 23/20*** | (2006.01) |

(52) U.S. Cl.

CPC ..... *F41C 23/04* (2013.01); *F41C 23/14* (2013.01); *F41C 23/20* (2013.01)

(58) Field of Classification Search

CPC ..... F41C 23/04

See application file for complete search history.

(56) References Cited

U.S. PATENT DOCUMENTS

| | | | |
|---|---|---|---|
| 543,138 | A | 6/1895 | Murray |
| 1,084,848 | A | 1/1914 | Demele |

(Continued)

FOREIGN PATENT DOCUMENTS

| | | | |
|---|---|---|---|
| CA | 2715748 | A1 | 3/2012 |
| CN | 204268966 | | 4/2015 |

(Continued)

OTHER PUBLICATIONS

Knoxx Axiom Ultra-Light Rifle Stock, Blackhawk.com [online], [site visited Nov. 17, 2017]. <URL: http://blackhawk.com/products/long-gun-accessories/stocks/rifle/knoxx-axiom-ultra-light-rifle-stock> (Year:2017).

(Continued)

*Primary Examiner* — Stephen Johnson

(74) *Attorney, Agent, or Firm* — Christensen, Fonder, Dardi & Herbert PLLC

(57) ABSTRACT

A stock for a firearm. In some embodiments, the stock is configured for bi-directional folding to either side of a receiver of the firearm. In some embodiments, the stock is configured for length adjustment. A biasing element is provided for the length adjustment that biases a proximal (butt) subassembly of the stock against the shoulder of the user. The user can adjust the length of the stock by moving his or her shoulder fore and aft against the butt of the stock. The bi-directional folding and the shoulder length adjustment aspects may be incorporated into a single embodiment.

14 Claims, 11 Drawing Sheets

(56) References Cited

U.S. PATENT DOCUMENTS 1,196,822 A * 9/1916 Sues ..... F41C 23/14 42/73
2,200,780 A 5/1940 Schmeisser
2,293,128 A 8/1942 Fortin
2,400,349 A 5/1946 Haberstump
2,424,944 A 7/1947 Patchett
2,437,548 A 3/1948 Patchett
2,441,487 A 5/1948 Howard
2,780,145 A 2/1957 Saive
3,020,662 A 2/1962 Merkel
3,123,928 A 3/1964 Lizza
3,369,316 A 2/1968 Miller
3,817,148 A 6/1974 Schirneker
3,897,729 A 8/1975 Schirneker
3,919,921 A 11/1975 Schirneker
4,063,379 A 12/1977 Ruger
4,299,046 A 11/1981 Atchisson
4,416,186 A 11/1983 Sullivan
4,513,523 A 4/1985 Gal
4,579,037 A 4/1986 Gillum
4,640,036 A 2/1987 Gal
4,735,007 A 4/1988 Gal
4,766,800 A 8/1988 Miller et al.
4,788,785 A 12/1988 White
4,967,642 A 11/1990 Mihaita
D324,557 S 3/1992 Livingston
5,410,833 A 5/1995 Paterson
5,519,957 A 5/1996 Iannetta
5,752,339 A 5/1998 Bentley et al.
5,916,087 A 6/1999 Owens
5,974,718 A 11/1999 Bentley et al.
6,250,009 B1 6/2001 Leontuk
6,470,617 B1 10/2002 Gregory et al.
6,490,822 B1 12/2002 Swan
6,499,245 B1 12/2002 Swan
6,523,374 B1 2/2003 Owens
6,543,173 B1 4/2003 Golan
6,598,329 B1 7/2003 Alexander
6,618,976 B1 9/2003 Swan
6,820,361 B2 11/2004 Popikow
6,925,743 B1 8/2005 DiGiovanna
D516,660 S 3/2006 Murello et al.
D517,637 S 3/2006 Murello et al.
7,104,001 B1 9/2006 DiGiovanna
RE39,465 E 1/2007 Swan
7,200,966 B2 4/2007 Gooder
7,243,454 B1 7/2007 Cahill
D551,313 S 9/2007 Saur et al.
7,337,573 B1 3/2008 DiGiovanna
RE40,216 E 4/2008 Swan
7,398,616 B1 7/2008 Weir
7,418,797 B1 9/2008 Crose
7,464,495 B2 12/2008 Cahill
7,526,991 B2 5/2009 Steimke et al.
D600,307 S 9/2009 Fitzpatrick et al.
D603,013 S 10/2009 Fitzpatrick et al.
7,673,412 B2 3/2010 Griffin
7,712,241 B2 5/2010 Teetzel et al.
7,717,024 B2 5/2010 Steimke et al.
7,762,018 B1 7/2010 Fitzpatrick et al.
7,802,392 B2 9/2010 Peterson et al.
D626,618 S 11/2010 Peterson et al.
7,823,313 B2 11/2010 Faifer
7,827,721 B2 11/2010 Griffin
D629,062 S 12/2010 Peterson et al.
7,849,626 B2 12/2010 Fluhr
7,866,078 B1 1/2011 Beretta
D636,833 S 4/2011 Mayberry et al.
D636,834 S 4/2011 Mayberry et al.
7,930,849 B2 4/2011 Abraham et al.
7,941,958 B1 5/2011 Zedrosser
7,966,761 B1 6/2011 Kuczynko et al.
D643,085 S 8/2011 Peterson et al.
7,987,623 B1 8/2011 Moody et al.
8,006,425 B2 8/2011 Burt et al.
D645,532 S 9/2011 Peterson et al.
D645,533 S 9/2011 Peterson et al.
8,091,265 B1 1/2012 Teetzel et al.
D661,366 S 6/2012 Zusman
8,245,429 B2 8/2012 Kuczynko et al.
D668,311 S 10/2012 Rogers et al.
8,296,986 B1 10/2012 Cook et al.
8,312,661 B2 11/2012 Ludlow
8,341,866 B1 1/2013 Gaddini et al.
8,393,104 B1 3/2013 Moody et al.
8,397,415 B2 3/2013 Laney et al.
8,397,416 B2 3/2013 Laney et al.
8,402,683 B2 3/2013 Cabahug et al.
8,407,925 B2 4/2013 Fesas
8,429,844 B2 4/2013 Dextraze et al.
8,448,366 B2 5/2013 Faifer
8,453,365 B1 6/2013 Ballard
D688,768 S 8/2013 Fitzpatrick et al.
8,522,465 B2 9/2013 Jarboe et al.
D692,087 S 10/2013 Fitzpatrick et al.
8,601,736 B2 12/2013 Andersson
8,631,601 B2 1/2014 Langevin et al.
8,640,373 B2 2/2014 Burt
8,656,622 B2 2/2014 Peterson et al.
8,656,623 B1 2/2014 Chvala
D704,294 S 5/2014 Jarboe
8,756,849 B2 6/2014 Troy
8,763,295 B2 7/2014 Trimble
8,769,855 B2 7/2014 Law
D710,477 S 8/2014 Kauranen
8,794,121 B2 8/2014 Steimke et al.
8,800,190 B1 8/2014 Wilde
8,820,212 B2 9/2014 Rostocil
8,844,185 B2 9/2014 Jarboe
8,850,735 B2 10/2014 Kenney
8,898,948 B1 12/2014 Gaddini et al.
8,915,005 B2 12/2014 Grimshaw et al.
8,919,238 B2 12/2014 Steimke et al.
D722,357 S 2/2015 Keller et al.
D724,691 S 3/2015 Barfoot et al.
8,984,789 B2 3/2015 Adcock, Jr.
8,984,791 B1 3/2015 Leslie
8,985,007 B2 3/2015 Larson et al.
8,991,088 B1 3/2015 Young
D728,057 S 4/2015 Daniel et al.
9,016,188 B2 4/2015 Larson et al.
D728,727 S 5/2015 Barfoot et al.
D728,728 S 5/2015 Barfoot et al.
D731,023 S 6/2015 Hirt et al.
D733,247 S 6/2015 Lewis et al.
D736,338 S 8/2015 Fitzpatrick et al.
D736,339 S 8/2015 Fitzpatrick et al.
9,109,855 B1 8/2015 Kincel
D738,981 S 9/2015 Zusman
D739,220 S 9/2015 Lee
D745,627 S 12/2015 Kielsmeier et al.
D748,216 S 1/2016 Zusman
9,228,795 B1 1/2016 Kielsmeier et al.
9,239,203 B2 1/2016 Jarboe et al.
9,279,640 B1 3/2016 Hurley et al.
D755,329 S 5/2016 Kielsmeier et al.
D760,326 S 6/2016 Chu
D771,765 S 11/2016 Ewer
9,488,435 B1 11/2016 Roberts et al.
D779,018 S 2/2017 Zayatz et al.
9,568,261 B1 2/2017 Hall
D792,936 S 7/2017 Eitan et al.
D792,937 S 7/2017 Eitan et al.
D795,985 S 8/2017 Frederickson et al.
2005/0115140 A1 6/2005 Little
2005/0215092 A1* 9/2005 Schoppman ..... F41A 11/04 439/101
2006/0005445 A1 1/2006 Elder
2006/0242880 A1 11/2006 Griffin
2006/0248686 A1 11/2006 Cook
2007/0006508 A1 1/2007 Baker et al.
2007/0199224 A1 8/2007 Bentley
2007/0271832 A1 11/2007 Griffin
2008/0028662 A1 2/2008 Abraham et al.

(56) References Cited

U.S. PATENT DOCUMENTS

| | | | |
|---|---|---|---|
| 2008/0236016 | A1 | 10/2008 | Fitzpatrick et al. |
| 2009/0139128 | A1 | 6/2009 | Fluhr |
| 2009/0229160 | A1 | 9/2009 | Elliott et al. |
| 2009/0277066 | A1 | 11/2009 | Burt et al. |
| 2009/0288324 | A1 | 11/2009 | Peterson et al. |
| 2010/0212206 | A1 | 8/2010 | Griffin |
| 2010/0229444 | A1 | 9/2010 | Faifer |
| 2010/0229450 | A1 | 9/2010 | Becker et al. |
| 2010/0242334 | A1 | 9/2010 | Kincel |
| 2010/0275489 | A1 | 11/2010 | Cabahug et al. |
| 2010/0307042 | A1 | 12/2010 | Jarboe et al. |
| 2011/0030258 | A1 | 2/2011 | Fistikchi et al. |
| 2011/0099874 | A1 | 5/2011 | Zedrosser |
| 2011/0131857 | A1 | 6/2011 | Kuczynko et al. |
| 2011/0192067 | A1 | 8/2011 | Troy |
| 2012/0011758 | A1 | 1/2012 | Burt |
| 2012/0030983 | A1 | 2/2012 | Kuczynko et al. |
| 2012/0047786 | A1 | 3/2012 | Dextraze et al. |
| 2012/0073177 | A1 | 3/2012 | Laney et al. |
| 2012/0079752 | A1 | 4/2012 | Peterson et al. |
| 2012/0131829 | A1 | 5/2012 | Fistikchi et al. |
| 2012/0131838 | A1 | 5/2012 | Edge et al. |
| 2012/0137556 | A1 | 6/2012 | Laney et al. |
| 2012/0137561 | A1 | 6/2012 | Ludlow |
| 2012/0137562 | A1 | 6/2012 | Langevin et al. |
| 2012/0144712 | A1 | 6/2012 | Rostocil |
| 2012/0174455 | A1 | 7/2012 | Edelman et al. |
| 2012/0174456 | A1 | 7/2012 | DePierro et al. |
| 2012/0180354 | A1 | 7/2012 | Sullivan et al. |
| 2012/0180360 | A1 | 7/2012 | Jones |
| 2013/0014418 | A1 | 1/2013 | Dextraze et al. |
| 2013/0326924 | A1 | 2/2013 | Jarboe et al. |
| 2013/0212920 | A1 | 8/2013 | Law |
| 2014/0075815 | A1 | 3/2014 | Jarboe |
| 2014/0075816 | A1 | 3/2014 | Larson et al. |
| 2014/0196345 | A1 | 7/2014 | Grimshaw et al. |
| 2014/0196346 | A1 | 7/2014 | Grimshaw et al. |
| 2014/0360074 | A1 | 12/2014 | Jarboe |
| 2015/0075051 | A1 | 3/2015 | Law |
| 2015/0113848 | A1 | 4/2015 | Monveldt et al. |
| 2015/0211820 | A1 | 7/2015 | McRee |
| 2015/0233656 | A1 | 8/2015 | Karagias |
| 2015/0316346 | A1 | 11/2015 | Brandt |
| 2015/0345881 | A1 | 12/2015 | Irvin |
| 2015/0345895 | A1 | 12/2015 | Young |
| 2016/0018184 | A1 | 1/2016 | Park |
| 2016/0025448 | A1 | 1/2016 | Kincel |
| 2016/0116250 | A1 | 4/2016 | Mather |
| 2017/0122698 | A1 | 5/2017 | Chu |

FOREIGN PATENT DOCUMENTS

| | | | | |
|---|---|---|---|---|
| GB | 168890 | A | | 6/1922 |
| GB | 465557 | | * | 5/1937 |
| GB | 561988 | A | | 6/1944 |
| GB | 581820 | A | | 10/1946 |
| GB | 754040 | A | | 8/1956 |
| GB | 937941 | A | | 9/1963 |
| JP | 2008008525 | | | 1/2008 |
| JP | 2010002086 | | | 1/2010 |
| WO | WO2009046456 | A1 | | 4/2009 |
| WO | WO2015116264 | A2 | | 8/2015 |

OTHER PUBLICATIONS

Knoxx Axiom A-Frame Carbine Stock, Blackhawk.com [online], [site visited Nov. 17, 2017]. <URL: http://Blackhawk.com/products/long-gun-accessories/stocks/rifle/knoxx-axiom-a-frame-carbine-stock> (Year: 2017).

MSR 15 Patrol, SavageArms.com [online], [site visited Nov. 17, 2017]. <URL: http://www.savagearms.com/firearms/model/msr15patrol> (Year: 2017).

Magpul ACS-L Carbine Stock MIL-SPEC Model-FLAT Dark Earth, BravoCompany USA.com [online], [site visited Nov. 17, 2017]. <URL: https://www.bravocompanyusa.comMagpul-ACS-L-Carbine-Stack-Mil-Spec-Model-FDE-p/mag378-fde.htm> (Year:2017).

* cited by examiner

ADJUSTABLE LENGTH BI-DIRECTIONAL FOLDING STOCK FOR FIREARM

RELATED APPLICATIONS

This application claims the benefit of U.S. Provisional Patent Application No. 62/357,753, filed Jul. 1, 2016, the disclosure of which is incorporated by reference herein.

BACKGROUND OF THE DISCLOSURE

Conventional folding stocks for various firearms, such as AK type rifles, fold to one side or the other, each having its own advantages and disadvantages. The most common direction is to the right side or in front of the ejection port of the rifle because many AK rifles use a side mounted rail for optics. This side rail is mounted to the left of the receiver. Right-folding stocks have the disadvantage of inhibiting access to the charging handle, safety selector, ejection port, and trigger of the rifle. Left-folding stocks have the disadvantage of not being compatible with side mounted rails.

Also, length adjustment of conventional adjustable stocks is a trial-and-error process. The user removes the firearm from his or her shoulder to make the adjustment, then remounts the firearm to the shoulder to see if the length of the conventional adjustable stock is ergonomically satisfactory. If still not satisfactory, the process is repeated. The iterative, trial-and-error process is time consuming, which can be a disadvantage in situations where a target is within range for a short period of time. The process also requires a lot of movement, which is a disadvantage if one is in cramped quarters, or is trying to avoid detection by the target.

The present disclosure discloses embodiments that address one or both of the above-identified disadvantages.

SUMMARY OF THE DISCLOSURE

Various embodiments of the disclosure enables bi-directional folding of a stock assembly to either side of a receiver. In this way, use of side rails is still viable by only folding the stock assembly to the right. However, when a side rail is not used, the stock can be folded to the left side for uninhibited access to the charging handle, safety selector, ejection port, and trigger.

Various embodiments of the disclosure provide a bias-assisted length adjustment of the stock assembly. The biasing of the length adjustment permits the user to adjust the length of the stock without having to grasp the movable member of the stock assembly with his or her hand. This is accomplished by placing a set pin on a portion of the stock that is in fixed relationship with the receiver. The user releases the set pin and manipulates the length of the stock with his or her shoulder. The biasing also enables rapid transition from a compact configuration to a fully extended configuration, as well as configurations in between, and with minimal movement on the part of the user.

Structurally, in various embodiments of the disclosure, a folding stock for a firearm is described, comprising a stock assembly including a butt end and a receiver end portion and defining a stock axis that extends from the butt end through the receiver end portion. The stock assembly includes a first side that faces away from the stock axis and a second side that faces away from the stock axis in a direction opposite the first side of the stock assembly. An adaptor is coupled to the receiver end portion of the stock assembly and for mounting to a receiver of a firearm, the adaptor defining a mounting axis that is parallel to a barrel axis of the firearm. The adaptor includes a first side that faces away from the mounting axis and a second side that faces away from the mounting axis in a direction opposite the first side of the adaptor. The receiver end portion of the stock assembly defines a first eye centered about a first eye axis and a second eye centered about a second eye axis, the first eye being disposed on the first side of the stock assembly, the second eye being disposed on the second side of the stock assembly. The adaptor defines a third eye centered about a third eye axis and a fourth eye centered about a fourth eye axis, the third eye being disposed on the first side of the adaptor, the fourth eye being disposed on the second side of the adaptor.

The folding stock can be arranged in three configurations: a battery configuration where the firearm is ready for firing, and one of two folded configurations for stowage and transport of the firearm. In a battery configuration, the stock axis of the stock assembly is substantially parallel with the mounting axis of the adaptor, the first eye axis is aligned with the third eye axis, and the second eye axis is aligned with the fourth eye axis, the adaptor being coupled to the stock assembly with a first mounting pin disposed in the first eye and the third eye, and with a second mounting pin disposed in the second eye and the fourth eye. In a first folded configuration, the first side of the stock assembly is adjacent the first side of the adaptor and the first eye axis is aligned with the third eye axis, the adaptor being coupled to the stock assembly with the first mounting pin disposed in the first eye and the third eye. In a second folded configuration, the second side of the stock assembly is adjacent the second side of the adaptor and the second eye axis is aligned with the fourth eye axis, the adaptor being coupled to the stock assembly with the second mounting pin disposed in the second eye and the fourth eye.

In some embodiments, the first eye axis and the second eye axis are parallel to each other to define a stock mounting plane that passes through the receiver end portion of the stock assembly, and the third eye axis and the fourth eye axis are parallel to each other to define an adaptor mounting plane that passes through the adaptor. In some embodiments, the third eye is one of two eyes defined by a trunnion structure disposed on the first side of the adaptor. In some embodiments, the stock mounting plane is substantially perpendicular to the stock axis, and the adaptor mounting plane is perpendicular to the mounting axis. The receiver end portion may include a mounting piece fastened to the stock assembly, the mounting piece defining the first eye and the second eye. In some embodiments, the mounting axis is parallel to the stock axis when in at least one of the first folded configuration and the second folded configuration. In some embodiments, the adaptor mounting plane is co-planar with the stock mounting plane of the stock assembly when in at least one of the first folded configuration and the second folded configuration.

In some embodiments, a bow spring is mounted to the adaptor, the bow spring including a first free end and a second free end. The first free end clips into a first notch defined on the first side of the stock assembly when in the first folded configuration to secure the folding stock assembly in the first folded configuration. The second free end clips into a second notch defined on the second side of the stock assembly when in the second folded configuration to secure the folding stock in the second folded configuration. In some embodiments, the first notch is distal to first eye axis and the second notch is distal to the second eye axis.

In various embodiments of the disclosure, an adjustable stock for a firearm is described, comprising a proximal stock subassembly a distal stock subassembly, and a biasing spring disposed therebetween. The proximal stock subassembly includes a proximal stock housing including a butt end, and an adjustment tube fixedly attached to the proximal stock housing. The adjustment tube defines an adjustment axis that extends distally from the proximal stock subassembly. The adjustment tube also defines a plurality of apertures, each aperture facing in a direction perpendicular to the adjustment axis. The distal stock subassembly includes a distal stock housing that defines an internal passageway, the adjustment tube being slidably engaged within the internal passageway. The distal stock subassembly further includes a stop portion that is in fixed relation to the distal stock housing, the stop portion being distal to the adjustment tube. A retractable set pin is coupled to the distal stock housing and arranged for selectively engaging any one of the plurality of apertures of the adjustment tube to releasably secure the proximal stock subassembly in a fixed relationship with the distal stock subassembly. A biasing spring is disposed between the proximal stock subassembly and the stop of the distal stock subassembly, the biasing spring exerting a biasing force parallel to the adjustment axis in a proximal direction on the proximal stock subassembly.

In some embodiments, the adjustment tube includes a cylindrical portion. In some embodiments, the adjustment tube includes a rail portion, the plurality of apertures being defined in the rail portion. In some embodiments, a lever is pivotally mounted to the distal stock housing and coupled to the retractable set pin for selectively engaging and disengaging the retractable set pin from the any one of the plurality of apertures. In some embodiments, the adjustable stock includes a receiver interface for coupling to a receiver of a firearm, wherein the receiver interface includes the stop portion.

In some embodiments, the proximal stock housing and the adjustment tube are unitary. In some embodiments, the biasing spring is coupled to the adjustment tube of the proximal stock subassembly.

In various embodiments, the biased length adjustment aspect is combined with the bi-directional folding aspect. That is, the receiver interface is an adaptor coupled to a receiver end portion of the adjustable stock, the adaptor defining a mounting axis that is parallel to a barrel axis of the firearm and including a first side that faces away from the mounting axis and a second side that faces away from the mounting axis in a direction opposite the first side of the adaptor. The receiver end portion of the stock assembly defines a first eye centered about a first eye axis and a second eye centered about a second eye axis, the first eye being disposed on the first side of the stock assembly, the second eye being disposed on the second side of the stock assembly. The adaptor defines a third eye centered about a third eye axis and a fourth eye centered about a fourth eye axis, the third eye being disposed on the first side of the adaptor, the fourth eye being disposed on the second side of the adaptor. In a battery configuration, the stock axis of the stock assembly is substantially parallel with the mounting axis of the adaptor, the first eye axis is aligned with the third eye axis, and the second eye axis is aligned with the fourth eye axis, the adaptor being coupled to the stock assembly with a first mounting pin disposed in the first eye and the third eye, and with a second mounting pin disposed in the second eye and the fourth eye. In a first folded configuration, the first side of the stock assembly is adjacent the first side of the adaptor and the first eye axis is aligned with the third eye axis, the adaptor being coupled to the stock assembly with the first mounting pin disposed in the first eye and the third eye. In a second folded configuration, the second side of the stock assembly is adjacent the second side of the adaptor and the second eye axis is aligned with the fourth eye axis, the adaptor being coupled to the stock assembly with the second mounting pin disposed in the second eye and the fourth eye.

In various embodiments of the disclosure, a method for adjusting the length of a stock of a firearm is disclosed, comprising:

providing a stock assembly for attachment to a receiver of the firearm, the stock assembly including a distal stock subassembly coupled in fixed relationship with the receiver, the distal stock subassembly including a retractable set pin, a proximal stock subassembly slidably engaged with the distal stock subassembly for translating the proximal stock subassembly relative to the distal stock subassembly, the proximal stock subassembly being configured to accept the retractable set pin of the distal stock subassembly for selectively securing the proximal stock subassembly in a fixed relationship with the distal stock subassembly, the retractable set pin being biased for securing the proximal stock subassembly to the distal stock subassembly, and a biasing spring disposed between the proximal stock subassembly and the distal stock subassembly, the biasing spring exerting a biasing force parallel to the adjustment axis in a proximal direction on the proximal stock subassembly; and providing instructions on a tangible, non-transitory medium, the instructions comprising grasping the distal stock subassembly with one hand to retract the retractable set pin and release the proximal stock subassembly from the distal stock subassembly, moving the proximal stock subassembly with a shoulder so that the stock assembly is at a desired length, and releasing the retractable set pin with the one hand to secure the proximal stock subassembly to the distal stock subassembly.

A feature and advantage of embodiments is a long gun with a stock that has a hinge mechanism that allow the stock to be folded to lay along the left side or the right side of the long gun. This allows selective access to long gun features or attachment on both sides of the long gun even with the long gun in a folded configuration.

DETAILED DESCRIPTION

Figure 1:
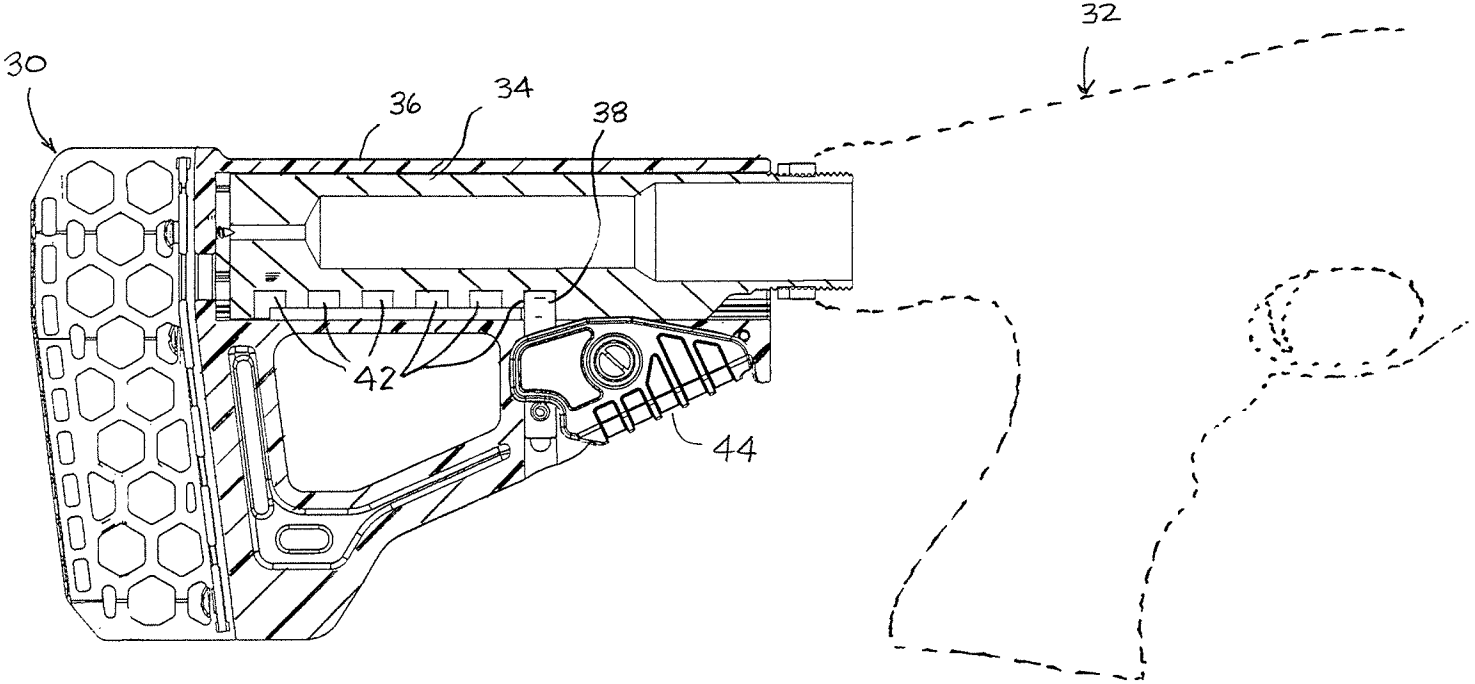
FIG. 1 (PRIOR ART)
FIG. 1 is a partial sectional view of a conventional adjustable stock.

Referring to FIG. 1, a conventional adjustable stock 30 mounted to a receiver 32 is depicted. The conventional adjustable stock 30 includes an adjustment tube 34 over which a housing 36 can be translated. The adjustment tube 34 is held in within the housing 36 by a set pin 38, the set pin 38 being biased toward engagement with a plurality of pockets 42. A lever 44 is mounted to the housing 36 for actuating the set pin 38 to selectively retract the set pin 38 from engagement with one of the plurality of pockets 42 defined in the adjustment tube 34. The housing 36 is thereby enabled for translation with respect to the adjustment tube 34. The adjustment tube 34 is mounted in fixed relation with the receiver 32. The housing 36, upon which the lever 44 is mounted, is moveable relative to the receiver 32.

To adjust the conventional adjustable stock 34, the user grips the receiver 32 with one hand and grips the conventional adjustable stock 30 at the lever 44 with the other hand, thereby actuating the lever 44 to retract the set pin 38 from the adjustment tube 34 and unlocking the adjustment tube 34 from the housing 36. The user then moves the housing 36 fore or aft so that the conventional adjustable stock 30 is at a different length, and then releases the lever 44 for seating of the set pin 38 within a different one of the plurality of pockets 42.

The adjustment of the conventional adjustable stock 30 is a trial-and-error process. The user removes the firearm from his or her shoulder to make the adjustment, then remounts the firearm to the shoulder to see if the length of the conventional adjustable stock is ergonomically satisfactory. If still not satisfactory, the process is repeated. The iterative, trial-and-error process is time consuming, which can be a disadvantage in situations where a target is within range for a short period of time. The process also requires a lot of movement, which is a disadvantage if one is in cramped quarters, or is trying to avoid detection by the target. The present disclosure discloses embodiments that address the above-identified concerns.

Figure 2:
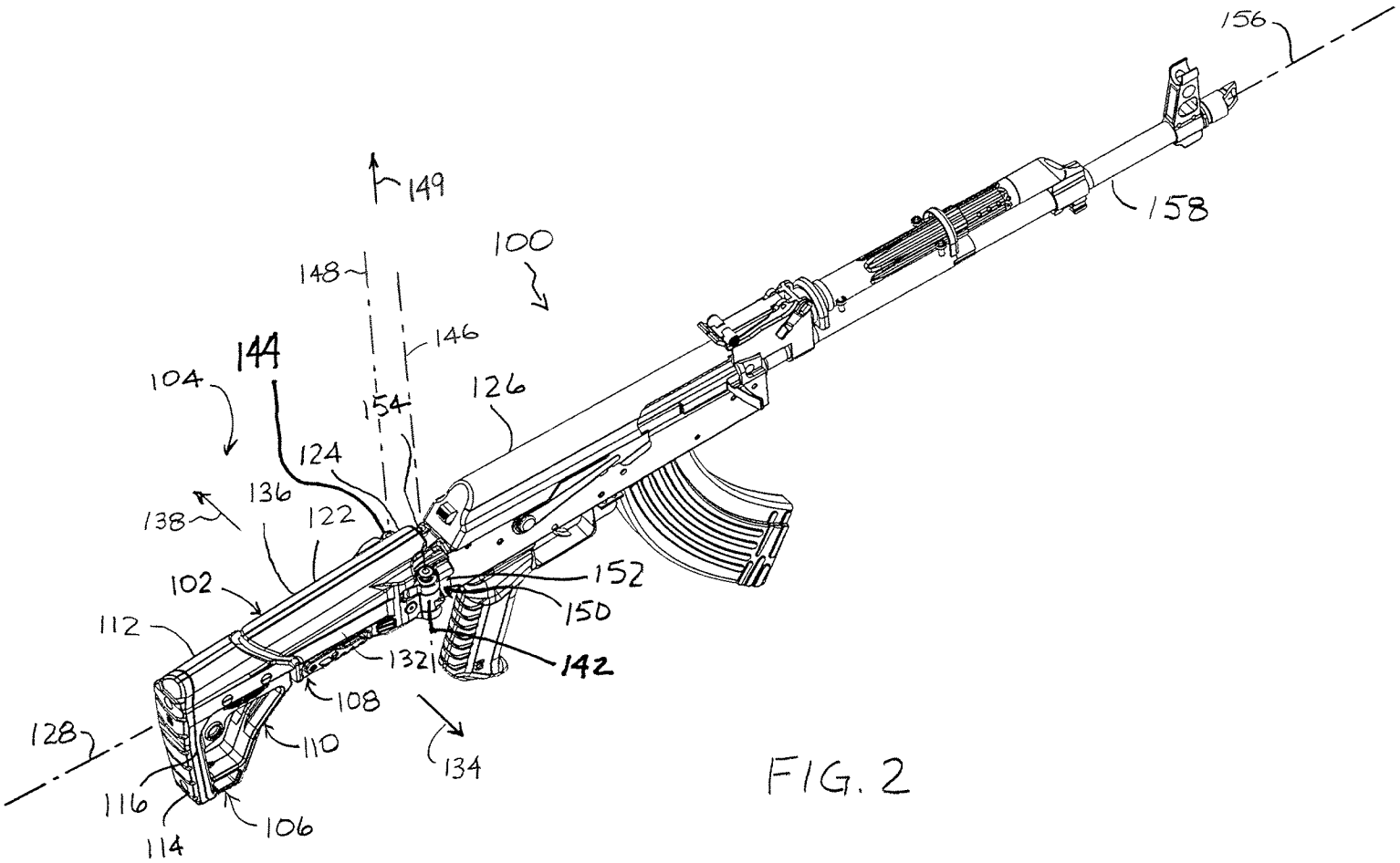
FIG. 2 is a perspective view of a firearm with an adjustable, foldable stock in a battery configuration according to an embodiment of the disclosure.

Referring to FIG. 2, a firearm 100, specifically a long gun, with an adjustable folding stock 102 is depicted in a battery configuration 104 in an embodiment of the disclosure. In the depicted embodiment, the adjustable folding stock 102 includes an adjustable stock assembly 110 having a proximal stock subassembly 106 and a distal stock subassembly 108. The proximal stock subassembly 106 includes a proximal stock housing 112 and a butt 114 mounted to a butt end 116 for registration against a shoulder of a user. The distal stock subassembly 108 includes a distal stock housing 122 including a receiver end portion 124 for coupling to a receiver 126 of the firearm 100. The adjustable stock assembly 110 defines a stock axis 128 that extends through the butt end 116 the receiver end portion 124. A first side 132 of the adjustable stock assembly 110 faces away from the stock axis 128 in a first lateral direction 134, and a second side 136 of the adjustable stock assembly 110 faces away from the stock axis 128 in a second lateral direction 138 that is opposite the first lateral direction 134.

In the depicted embodiment, the adjustable stock assembly 110 includes a double hinge mechanism comprising a first pivot assembly 142 disposed on the first side 132 and a second pivot assembly 144 disposed on the second side 136. The first pivot assembly 142 defines a first pivot axis 146 that extends substantially parallel to the first side 132. The second pivot assembly 144 defines a second pivot axis 148 that extends substantially parallel to the second side 136. Both the first pivot axis 146 and the second pivot axis 148 may extend in a direction 149 that is substantially perpendicular to the stock axis 128.

The adjustable folding stock 102 may also include an adaptor 150 coupled to the receiver end portion 124 of the adjustable stock assembly 110 for mounting with the receiver 126 of the firearm 100. The adaptor 150 includes features 152 for coupling to the receiver 126 of the firearm 100 and defines a mounting axis 154 (FIG. 3) that, when mounted to the receiver 126 of the firearm 100, is parallel to a firing axis 156 of a barrel 158 of the firearm 100. The adaptor 150 includes a first side 162 that faces away from the mounting axis 154 in the first lateral direction 134 and a second side 164 that faces away from the mounting axis 154 in the second lateral direction 138.

Figure 3:
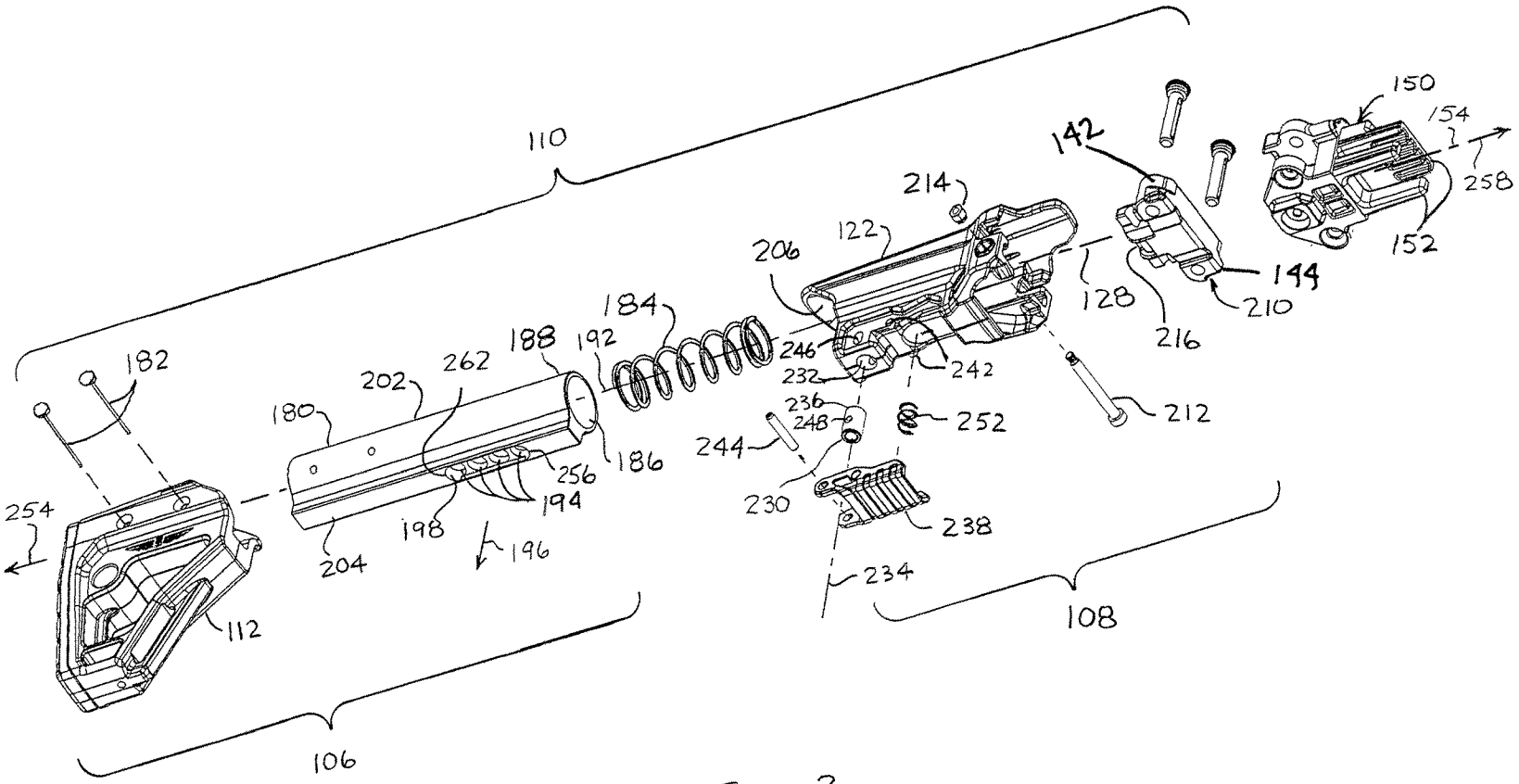
FIG. 3 is an exploded view of an adjustable, foldable stock in a battery configuration according to an embodiment of the disclosure.
Figure 4:
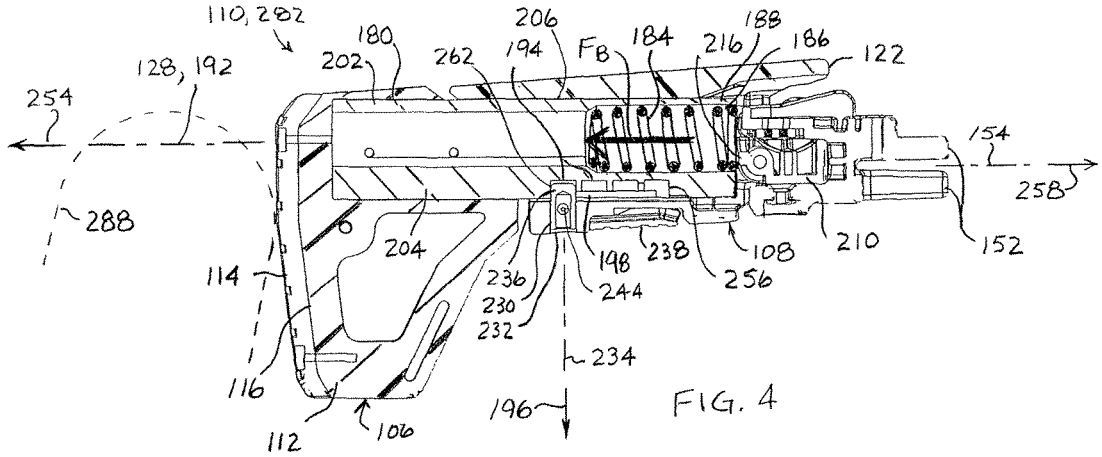
FIG. 4 is a sectional view of an adjustable, foldable stock in a compact configuration according to an embodiment of the disclosure.

Referring to FIGS. 3 and 4, the components of the adjustable stock assembly 110 are depicted in an embodiment of the disclosure. In the depicted embodiment, the proximal stock housing 112 of the proximal stock subassembly 106 is adapted to receive an adjustment tube 180, the adjustment tube 180 being fixedly attached to the proximal stock housing 112, for example with fasteners 182. Alternatively, the proximal stock housing 112 and the adjustment tube 180 are unitary (i.e., integrally formed). In some embodiments, a biasing spring 184 is disposed in a recess or bore 186 defined at and accessible from a distal end portion 188 of the adjustment tube 180. The adjustment tube 180 defines an adjustment axis 192 that extends along the proximal stock subassembly 106. For embodiments incorporating the adjustment tube 180, the adjustment axis 192 defines the stock axis 128. The adjustment tube 180 defines a plurality of apertures 194, each aperture 194 facing in a direction 196 perpendicular to the adjustment axis 192. The apertures 194 may be, but need not be, defined at the mouth of pockets formed in the adjustment tube (as depicted). Other aperture structures may be utilized, for example, as through-holes formed in the wall of the adjustment tube 180. In some embodiments, the apertures 194 are defined at the base of a longitudinal recess 198 that extends substantially parallel to the adjustment axis 192. The adjustment tube 180 may include a cylindrical portion 202. In some embodiments, the adjustment tube 180 includes a rail portion 204 disposed along one side thereof, for example on one side of the cylindrical portion 202, the apertures 194 being defined in the rail portion 204.

The distal stock housing 122 that defines an internal passageway 206 extending along the adjustment axis 192. The internal passageway 206 is shaped and dimensioned to enable the distal end portion 188 of the adjustment tube 180 to slide therein along the adjustment axis 192. In some embodiments, the receiver end portion 124 of the distal stock subassembly 108 includes a mounting fitment 210 attached to the distal stock housing 122, for example, with a cross bolt 212 and nut 214. The mounting fitment 210 may define a stop portion 216 for the biasing spring 184 that is in fixed relation to the distal stock housing 122, the stop portion 216 being distal to the adjustment tube 180. Alternatively, the stop portion 216 may be provided another way, for example by structure (not depicted) that extends into the internal passageway 206. Such structure may be integrally formed with the distal stock housing 122.

In some embodiments, a retractable set pin 230 is disposed within a bore 232 defined in the distal stock housing 122, the retractable set pin 230 being translatable along an actuation axis 234 and being arranged for selectively engaging any one of the plurality of apertures 194 of the adjustment tube 180. The retractable set pin 230 may be characterized as having a head portion 236. A lever 238 may be pivotally mounted to the distal stock housing 122, for example on trunnion projections 242, and coupled to the retractable set pin 230 for selectively engaging and disengaging the retractable set pin 230 from the adjustment tube 180. The lever 238 may be coupled to the retractable set pin 230 with a cross pin 244, the cross pin 244 being accessible through opposed lateral slots 246 that pass laterally through the bore 232. In the depicted embodiment, the cross pin 244 passes through lateral holes 248 defined in the retractable set pin 230. In some embodiments, a return spring 252 biases the lever 238 so that the retractable set pin 230 is biased into engagement with the adjustment tube 180.

In assembly of the distal stock subassembly 108, the mounting fitment 210 (if utilized) is affixed to the receiver end portion 124 of the distal stock housing 122 to provide the stop portion 216. The retractable set pin 230 may be inserted into the bore 232, but retracted so that the retractable set pin 230 is clear of the internal passageway 206 of the distal stock housing 122. The adjustment tube 180 is affixed to the proximal stock housing 112, and the biasing spring 184 disposed within the bore 186 at the distal end portion 188 of the adjustment tube 180. The distal stock subassembly 108 is aligned and oriented with the adjustment tube 180 and slid over the distal end portion 188 of the adjustment tube 180 to put the biasing spring 184 into compression between the stop portion 216 of the distal stock subassembly 108 and the adjustment tube 180. The sliding of the distal stock subassembly 108 over the adjustment tube 180 continues until the actuation axis 234 is brought into substantial alignment with one of the plurality of apertures 194 of the alignment tube. The retractable set pin 230 is then set within the aligned aperture 194 to secure the proximal stock subassembly 106 to the distal stock subassembly 108.

The retractable set pin 230 is oriented so that the lateral holes 248 of the retractable pin are aligned with the lateral slots 246 formed in the distal stock housing 122. The cross pin 244 is inserted through the lateral holes 248 and lateral slots 246 so that the cross pin 244 extends from both lateral slots 246 of the distal stock housing 122. In this way, the retractable set pin 230 is also captured within the bore 232, but able to translate along the actuation axis 234. Also, in some embodiments, the lateral slots 246 limit the stroke of the retractable set pin 230 so that the head portion 236 of the retractable set pin 230 cannot be withdrawn from the longitudinal recess 198 of the adjustment tube 180. That is, the stroke of the retractable set pin 230 enables disengagement from the apertures 194, but not from the longitudinal recess 198. The return spring 252 is positioned on the distal stock housing 122 and the lever 238 snapped onto the trunnion projections 242 so that the return spring 252 is captured and compressed between the lever 238 and the distal stock housing 122. The lever 238 is also attached to the protruding ends of the cross pin 244, enabling actuation of the retractable set pin 230 with the lever 238.

Functionally, compression of the biasing spring 184 between the stop portion 216 of the distal stock subassembly 108 and the adjustment tube 180 exerts a biasing force FB on the proximal stock subassembly 106 in a proximal direction 254 (i.e., in a direction along the adjustment axis 192 toward the butt end 116 of the stock assembly 110). Upon release of the retractable set pin 230, the biasing force FB causes the proximal stock subassembly 106 to slide in the proximal direction 254. The adjustment tube 180 can be translated along the adjustment axis 192 within the distal stock housing 122 so that any one of the plurality of apertures 194 on the adjustment tube 180 is aligned with the actuation axis 234 of the retractable set pin 230.

The retractable set pin 230 is actuated along the actuation axis 234 to selectively engage or disengage the retractable set pin 230 from a given aperture 194 on the adjustment tube 180. For example, the retractable set pin 230 may be brought into engagement with the adjustment tube 180 (e.g., by releasing the spring-biased lever 238) while sliding the adjustment tube 180 within the distal stock housing 122. The retractable set pin 230 then engages one of the plurality of apertures 194 as the aperture 194 slides into substantial alignment with the actuation axis 234. Note that, for embodiments where the head portion 236 of the retractable set pin 230 remains within the longitudinal recess 198 when fully retracted, the head portion 236 of the retractable set pin 230 acts as a stop that prevents the proximal stock subassembly 106 from extending so far in the proximal direction 254 (rearward) that the proximal stock subassembly 106 becomes decoupled from the distal stock subassembly 108 by engaging with a distal end 256 of the longitudinal recess 198 at the proximal extremity of the adjustment range. Likewise, the head portion 236 of the retractable set pin 230 acts as a stop that prevents the proximal stock subassembly 106 from extending so far in a distal direction 258 (forward) so that the proximal stock housing 112 and the distal stock housing 122 collide by engaging a proximal end 262 of the longitudinal recess 198 at the distal extremity of the adjustment range. The retractable set pin 230, being coupled to the distal stock housing 122, secures the proximal stock subassembly 106 in a fixed relationship with the distal stock subassembly 108 when engaged in one of the plurality of apertures 194.

The biasing spring 184 may be sized or positioned so that it exerts a biasing force FB to some degree throughout the range of adjustment. That is, in an embodiment utilizing a coiled spring (depicted), the coiled spring is sized to be in compression throughout the range of adjustment. Also, the biasing spring 184 is sized so that the magnitude of the force exerted by the spring is easily overcome by the user during adjustment of the stock. In various embodiments, the biasing force FB is in a range of 3 lbf (pounds-force) to 25 lbf inclusive. (Herein, a range that is "inclusive" includes the end points of the range as well as all values between the endpoints.) In some embodiments, the biasing force FB is in the range of 5 lbf to 15 lbf inclusive. In some embodiments, the biasing force FB is in the range of 8 lbf to 11 lbf inclusive.

It is noted that, while embodiments presented herein depict a coil spring as the biasing spring 184, other spring forms are contemplated. Instead of a coil spring, an elastic plug could be implemented that exerts a biasing force FB upon compression. Other spring forms include spring fingers that engage the adjustment tube 180 and are deflected throughout the adjustment range.

Figure 5:
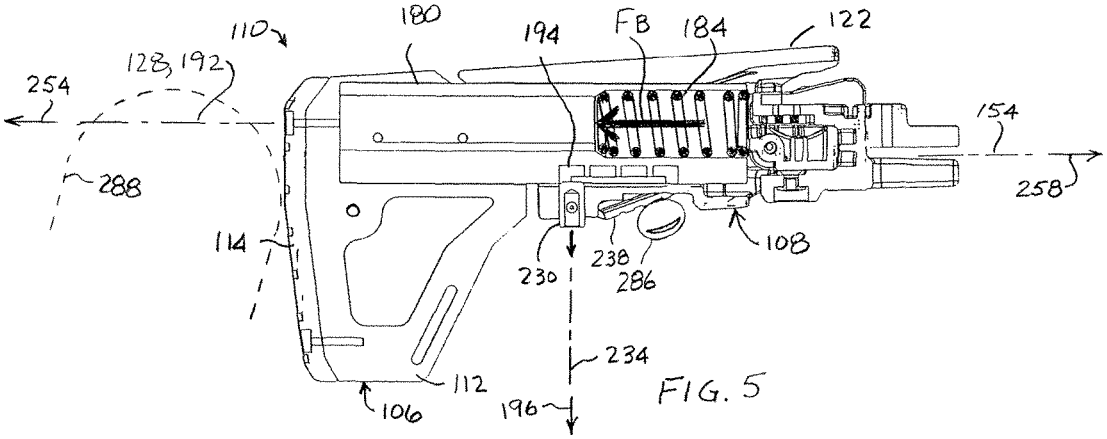
FIG. 5 is a sectional view of the adjustable, foldable stock of FIG. 4 released for length adjustment according to an embodiment of the disclosure.
Figure 6:
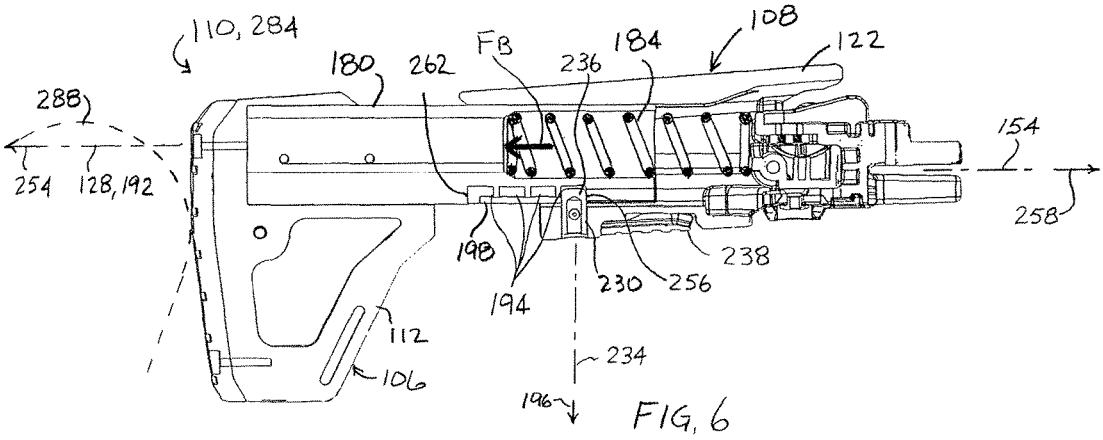
FIG. 6 is a sectional view of the adjustable, foldable stock of FIG. 4 in an extended configuration according to an embodiment of the disclosure.

Referring to FIGS. 4 through 6, operation of the adjustable stock assembly 110 is depicted in an embodiment of the disclosure, illustrating extension of the adjustable stock assembly 110 from a compact configuration 282 to an extended configuration 284. In the compact configuration 282 of FIG. 4, the retractable set pin 230 is engaged with the rearward-most of the apertures 194 of the adjustment tube 180. In this configuration, the distal stock subassembly 108 is releasably secured to the proximal stock subassembly 106 with the biasing spring 184 is under a high degree of compression, thereby generating the biasing force FB on the proximal stock subassembly 106, the biasing force FB being in the proximal direction 254 along the adjustment axis 192.

To release the proximal stock subassembly 106 from the distal stock subassembly 108, the user depresses the lever 238, for example by gripping the distal stock housing 122 with his or her hand so that a finger 286 of the hand is in compressive contact with the lever 238. The lever 238 pivots to retract the retractable set pin 230 from the aperture 194 (FIG. 5). Upon disengagement of retractable set pin 230, the proximal stock subassembly 106 is free to extend relative to the distal stock subassembly 108 and in the proximal direction 254 (rearward) under the influence of the biasing force FB exerted by the biasing spring 184. The user may block the rearward progression of the proximal stock subassembly 106 with his or her shoulder 288 registered against the butt 114 of the stock assembly 110. The user may also adjust the position of the apertures 194 relative to the retractable set pin 230 along the adjustment axis 192 by moving his or her shoulder 288 proximally and distally (fore and aft). Because of the biasing force FB exerted on the proximal stock subassembly 106, contact between the stock assembly 110 and the user's shoulder 288 is maintained during the adjustment, but is easily overcome as the user adjusts the length with his or her shoulder 288. Once the preferable length is attained, the lever 238 is released from the user's grip, and the return spring 252 biases the retractable set pin 230 into engagement with either an aligned aperture 194 or with the base of the longitudinal recess 198 (FIG. 6). In case of the latter, some additional adjustment with the user's shoulder 288 may be required until the retractable set pin 230 registers within one of the apertures 194 that is proximate the retractable set pin 230.

It is further noted that the hands of the user can remain stationary relative to the receiver 126 throughout the adjustment process. For example, for a right-handed user, the right hand may grip the receiver 126 as is done when firing the weapon, while the left hand grips the distal stock subassembly 108 and operates the lever 238. Accordingly, movement of proximal stock subassembly 106 may be done purely by movement of the user's shoulder 288 relative to the hands gripping the firearm 100, while hands of the user remain stationary relative to the firearm 100. In this way, the user can readily find and set an ergonomically preferable stock length for a given situation, without dismounting the firearm 100 from the shoulder 288.

In various embodiments, the adjustable stock assembly 110 is provided as a kit for retrofitting to the receiver 126. Instructions for use of the adjustable stock assembly 110 may be provided with the kit, the instructions being based on the description above attendant to FIGS. 4 through 6. In some embodiments, the instructions are provided on a tangible, non-transitory medium, such as written instructions on paper, or a medium such as a hard drive, flash drive, or compact disk, suitable for display on an electronic device, such as a personal computer, digital tablet, or smart phone.

Figures 7, 8:
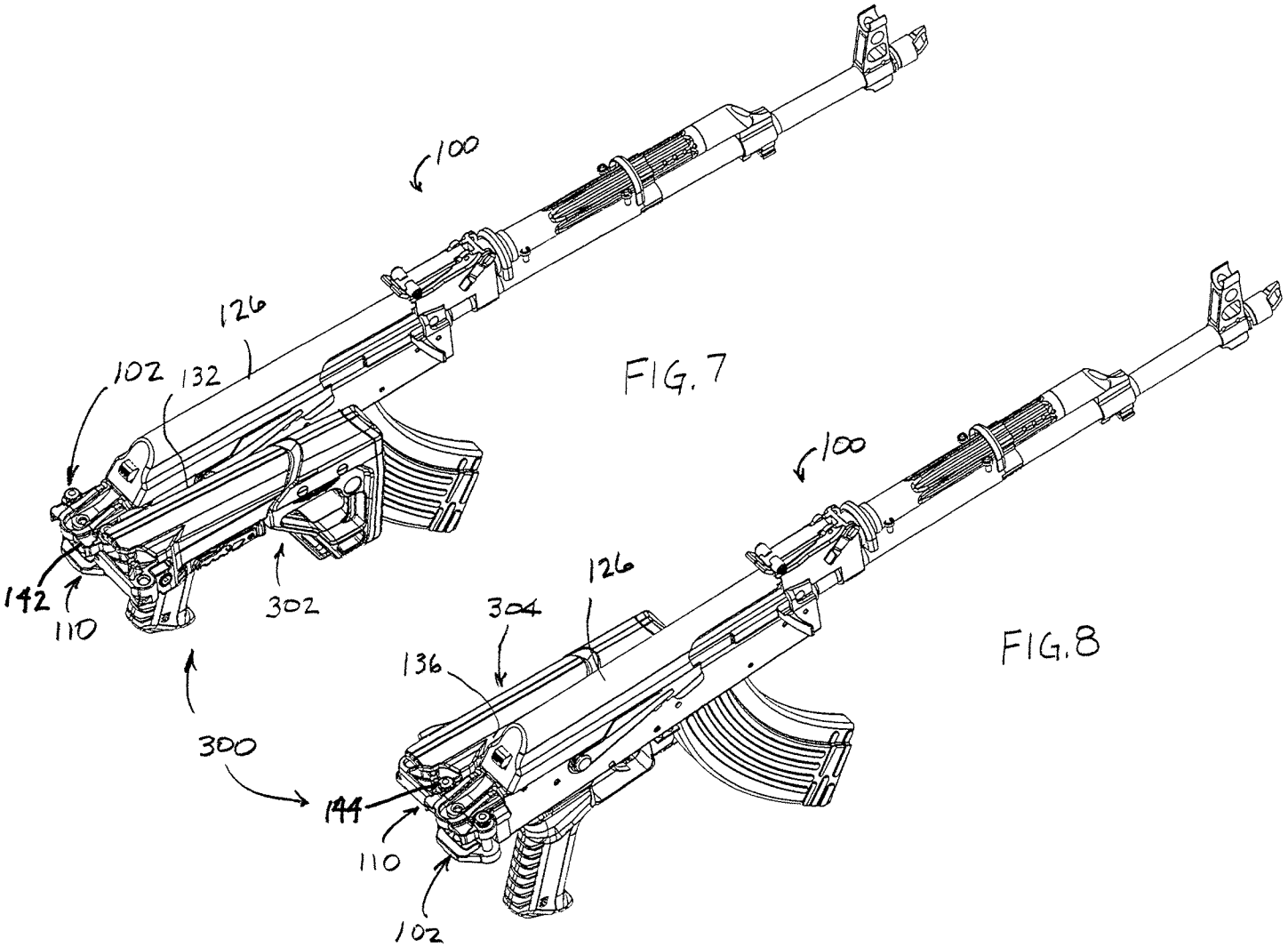
FIG. 7 is a perspective view of the firearm of FIG. 2 in a first folded configuration according to an embodiment of the disclosure.
FIG. 8 is a perspective view of the firearm of FIG. 2 in a second folded configuration according to an embodiment of the disclosure.

Referring to FIGS. 7 and 8, the firearm 100 with adjustable folding stock 102 is depicted in an embodiment of the disclosure. In this embodiment, the adjustable folding stock 102 includes a bi-directional folding arrangement 300, capable of being configured in both a first folded configuration 302 and a second folded configuration 304. In the first folded configuration 302, the stock assembly 110 is rotated relative to the battery configuration 104 of FIG. 2 so that the first side 132 of the adjustable stock assembly 110 is adjacent the receiver 126. In the second folded configuration 304, the adjustable stock assembly 110 is rotated relative to the battery configuration 104 so that the second side 136 of the adjustable stock assembly 110 is adjacent the receiver 126.

Figure 9:
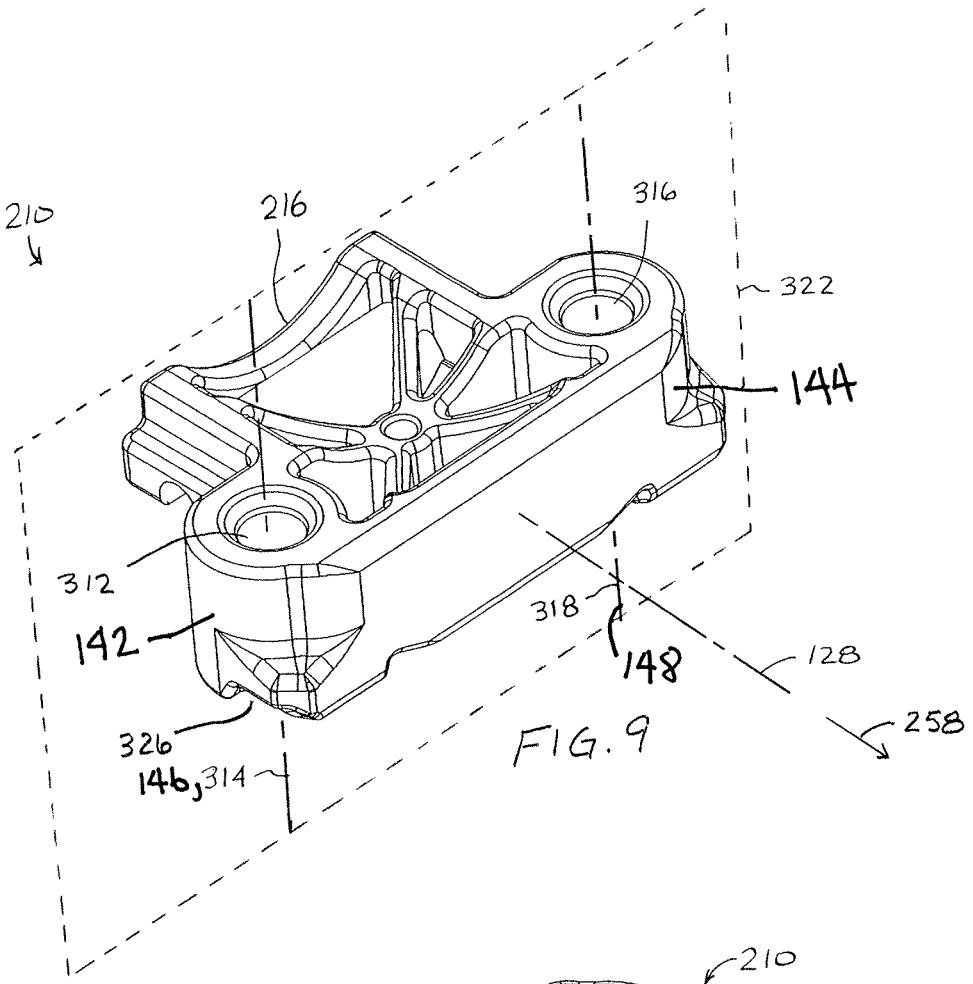
FIG. 9 is an upper front perspective view of a mounting fitment according to an embodiment of the disclosure.
Figure 10:
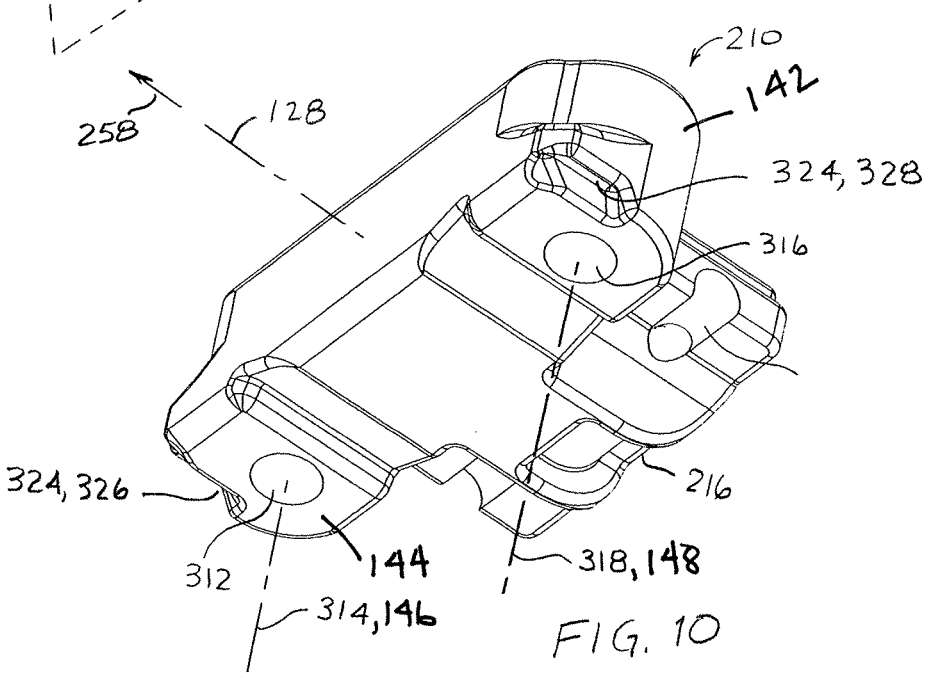
FIG. 10 is a lower front perspective view of the mounting fitment of FIG. 9 according to an embodiment of the disclosure.

Referring to FIGS. 9 and 10, the aspects of the mounting fitment 210 that enable the bi-directional folding arrangement 300 of FIGS. 7 and 8 are depicted in an embodiment of the disclosure. In the depicted embodiment, the mounting fitment 210 includes the first pivot assembly 142 and the second pivot assembly 144. The first pivot assembly 142 defines a first eye 312 disposed on the first side 132 of the stock assembly 110, the first eye 312 being centered about a first eye axis 314, the first eye axis 314 corresponding to the first pivot axis 146. The second pivot assembly 144 defines a second eye 316 disposed on the second side 136 of the adjustable stock assembly 110, the second eye 316 being centered about a second eye axis 318, the second eye axis 318 corresponding to the second pivot axis 148. In some embodiments, the first pivot axis 146 and the second pivot axis 148 (e.g., the first eye axis 314 and the second eye axis 318) are parallel to each other to define a stock mounting plane 322 that passes through the mounting fitment 210, and subsequently through the receiver end portion 124 of the stock assembly 110. In the depicted embodiment, the stock mounting plane 322 is substantially perpendicular to the stock axis 128.

In some embodiments, the mounting fitment 210 defines a pair of notches 324 that are laterally opposed on the mounting fitment 210. Accordingly, when the mounting fitment 210 is mounted to the distal stock housing 122, a first notch 326 of the pair of notches 324 is defined on the first side 132 of the stock assembly 110, and a second notch 328 of the pair of notches 324 is defined on the second side 136 of the stock assembly 110. In some embodiments, the notches 324 are defined distal to the first and second eye axes 314 and 318. The mounting fitment 210 may also define a through passage 332 that extends laterally therethrough for insertion of the cross bolt 212 to mount the mounting fitment 210 to the distal stock housing 122.

The depicted embodiments utilize the mounting fitment 210 to provide the first and second eyes 312 and 316 as described to the receiver end portion 124 of the stock assembly 110. In a broader sense, the mounting fitment 210 acts as a receiver interface 334 for coupling to the receiver 126 of the firearm 100, wherein the receiver interface 334 includes the stop portion 216. As such, it is also contemplated that the first and second eyes 312 and 316 may be provided at the receiver end portion 124 of the stock assembly 110 in other ways, such as by structure that is unitary (integrally formed) with the distal stock housing 122.

Figure 12:
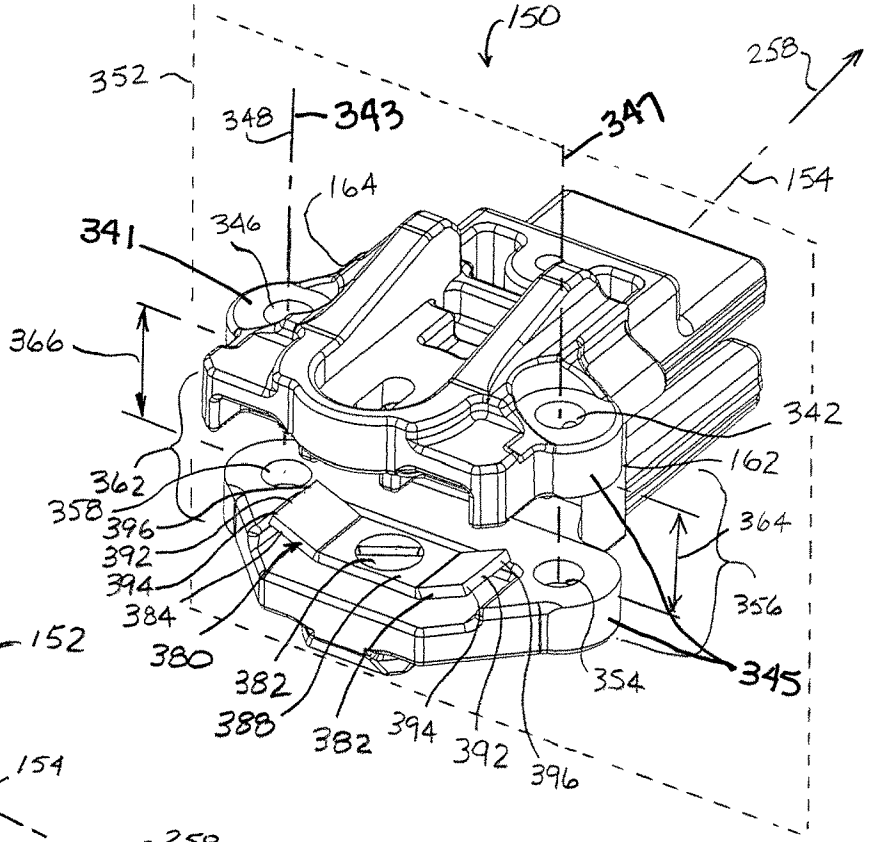
FIG. 12 is an upper rear perspective view of the adaptor of FIG. 11 according to an embodiment of the disclosure.
Figure 11:
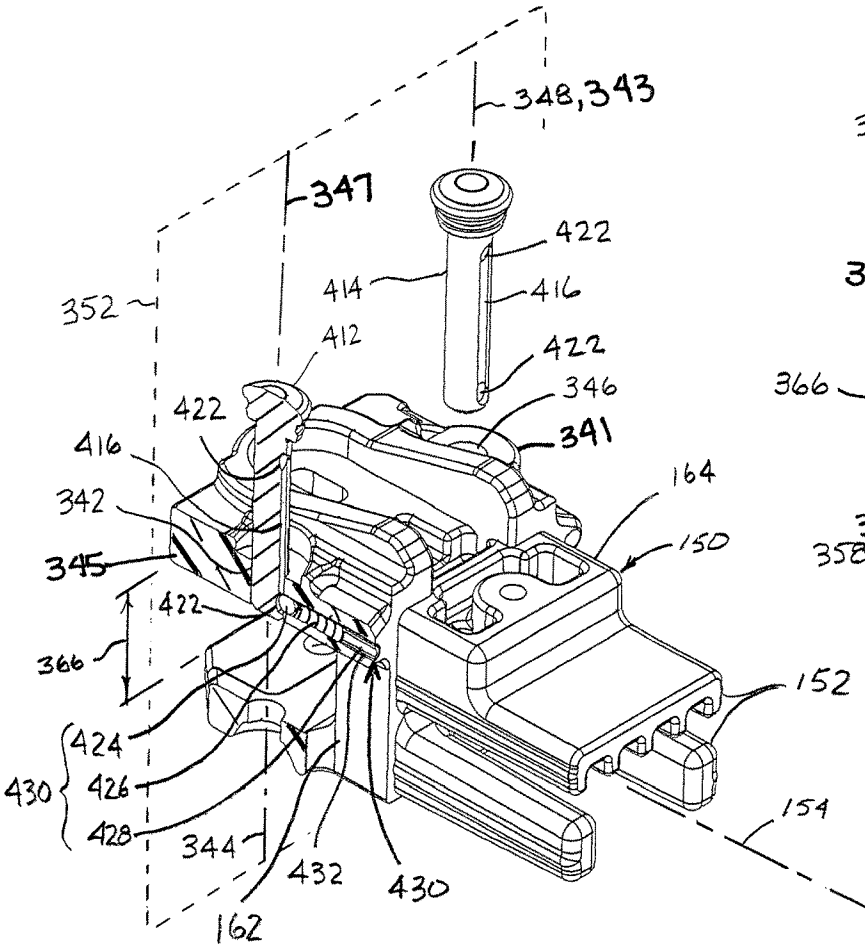
FIG. 11 is an upper front perspective view in partial cross-section of an adaptor for coupling the receiver to the stock assembly of FIG. 2 according to an embodiment of the disclosure.

Referring to FIGS. 11 and 12, the aspects of the adaptor 150 that enable the bi-directional folding arrangement are depicted in an embodiment of the disclosure. In the depicted embodiment, the adaptor 150 includes a first pin receiving structure 341 disposed on the first side 162 of the adaptor 150 that defines a first receiving axis 343. In some embodiments, the first pin receiving structure 341 defines a third eye 342 centered about a third eye axis 344, the third eye axis 344 corresponding to the first receiving axis 343. The depicted embodiment of the adaptor 150 also includes a second pin receiving structure 345 disposed on the second side 164 of the adaptor 150 that defines a second receiving axis 347. In some embodiments, the second pin receiving structure 345 defines a fourth eye 346 centered about a fourth eye axis 348. In some embodiments, the first receiving axis 343 and the second pin receiving axis 347 (i.e., the third eye axis 344 and the fourth eye axis 348) are parallel to each other to define an adaptor mounting plane 352 that passes through the adaptor 150. In the depicted embodiment, the adaptor mounting plane 352 is substantially perpendicular to the mounting axis 154 of the adaptor 150. In the depicted embodiment, the third eye 342 is one of two eyes 342 and 354 defined by a trunnion structure 356 disposed on the first side 162 of the adaptor 150; likewise, the fourth eye 346 is one of two eyes 346 and 358 defined by a trunnion structure 362 disposed on the second side 164 of the adaptor 150. Each trunnion structure 356 and 362 defines a respective gap 364 and 366 between the two eyes 342, 354 and 346, 358.

In some embodiments, a bow spring 380 for engaging the notches 324 of the stock assembly 110 is mounted to the adaptor 150, for example with a fastener 382. The bow spring 380 includes a first free end 384 and a second free end 386, the bow spring 380 being mounted to the adaptor 150 at a central portion 388 of the bow spring 380. Each free end 382, 384 is characterized as having an engagement edge 392 that extends generally parallel to the mounting axis 154, the engagement edge 392 having a proximal portion 394 and a distal portion 396.

The adaptor 150 and mounting fitment 210 are configured to accommodate first and second mounting pins 412 and 414. In some embodiments, the first and second mounting pins 412 and 414 are captured but translatable within the third and fourth eyes 342 and 346, respectively, of the mounting assembly. Each mounting pin 412, 414 may include a groove 416 extending lengthwise on one side, with detents 422 and 424 defined at respective ends of the groove 416. In the depicted embodiment, the third and fourth eyes 342 and 346 are accessed by a respective ball plunger 430 disposed within an axial bore 432 that interfaces the respective eye, the axial bore 432 extending perpendicular to the respective eye axis 344 or 348. The ball plunger 430 includes a ball 424, compression spring 426, and set sleeve 428 that are housed within the axial bore 432. The ball 424 and compression spring 426 are captured between the groove 416 of the mounting pin 412 or 414 and the set sleeve 428.

In assembly, the mounting pins 412 and 414 are disposed within the respective eyes 342 and 346 and oriented so that the groove 416 interfaces the axial bore 432 for housing the ball plunger 430. The ball 424 is fed into the axial bore 432, followed by the compression spring 426. The set sleeve 428 is then tamped into the axial bore 432. The length of the compression spring 426 and the length of the set sleeve 428 may be specified so that, when the set sleeve 428 is tamped flush with an access opening 434 of the axial bore 432, the compression spring 426 is compressed to exert a desired force on the ball 424 against the groove 416 and detent 422 or 424.

In operation, the ball 424 rides within the groove 416 as the respective mounting pin 412 or 414 is translated through the respective eye. At the ends of the groove 416, the ball 424 is set within the respective detent 422 or 424. In this way, the ball 424 and detent 422, 424 releasably secure the mounting pin 412 or 414 in either a mounted or a fully retracted configuration. In some embodiments, the respective mounting pin 412 or 414 is clear of the gap 364, 366 defined by the respective trunnion structure 354 of the adaptor 150 when in the fully retracted configuration (depicted in FIG. 11).

Figure 13:
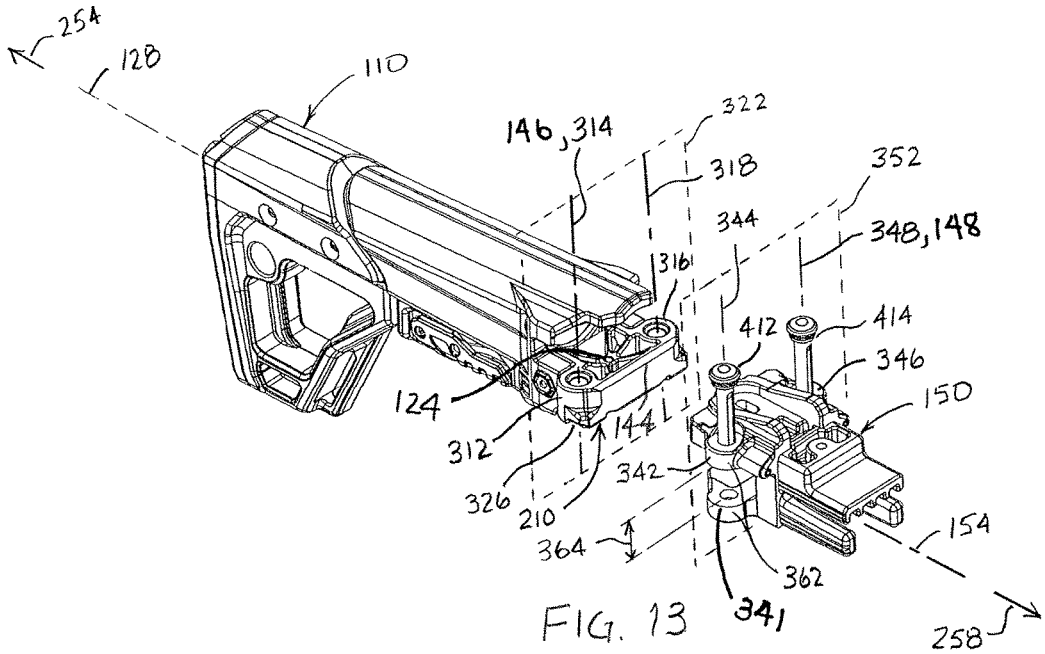
FIGS. 13 and 14 are front perspective views of the assembly of the adjustable, foldable stock in the battery configuration of FIG. 2 according to an embodiment of the disclosure.
Figure 14:
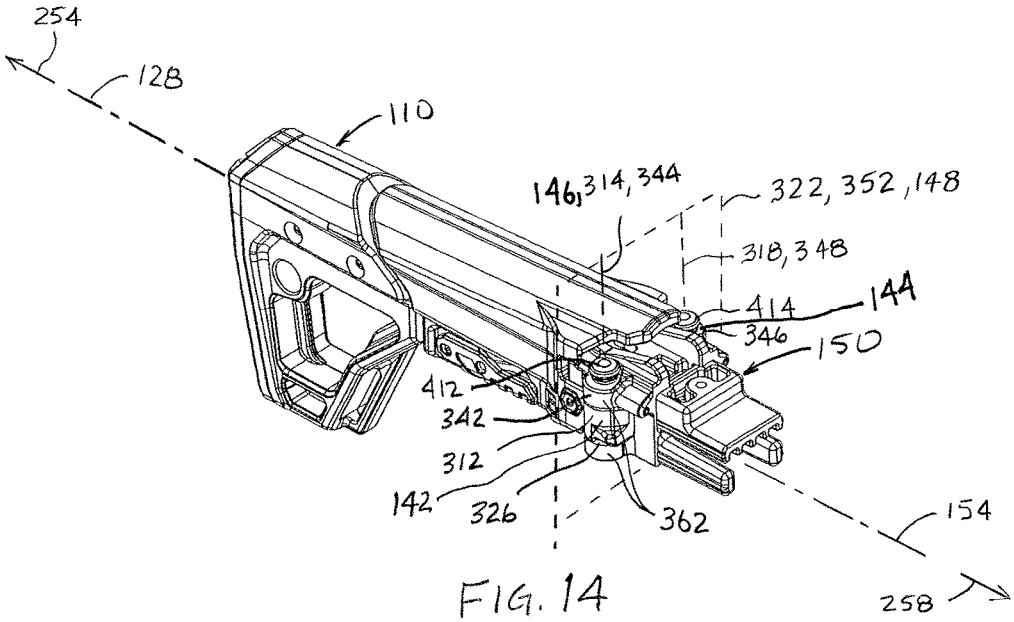

Referring to FIGS. 13 and 14, assembly and operation of the adjustable folding stock 102 for the battery configuration 104 of FIG. 2 is depicted in an embodiment of the disclosure. The adaptor 150 is aligned and oriented for coupling with the receiver end portion 124 of the stock assembly 110, with the mounting pins 412, 414 fully retracted (FIG. 13). The adaptor 150 is then brought into contact with the receiver end portion 124 of the stock assembly 110 so that the first eye axis 314 (i.e., the first pivot axis 146) of the mounting fitment 210 is substantially aligned with third eye axis 344 (i.e., the first receiving axis 343) of the adaptor 150, and the second eye axis 318 (i.e., the second pivot axis 148) of the mounting fitment 210 is substantially aligned with fourth eye axis 348 (i.e., the second receiving axis 347) of the adaptor 150. With the eye axes 314, 344 and 318, 348 (i.e., pivot axes 146, 148 and receiving axes 343, 347) so aligned, the mounting pins 412, 414 are set into the mounting configuration (FIG. 14). In the battery configuration 104, the stock axis 128 of the stock assembly 110 is substantially parallel with the mounting axis 154 of the adaptor 150, and the firearm 100 is ready for firing operation. In the battery configuration 104, the stock assembly 110 is ready for adjustment pursuant to the discussion above attendant to FIGS. 4 through 6.

Figure 16:
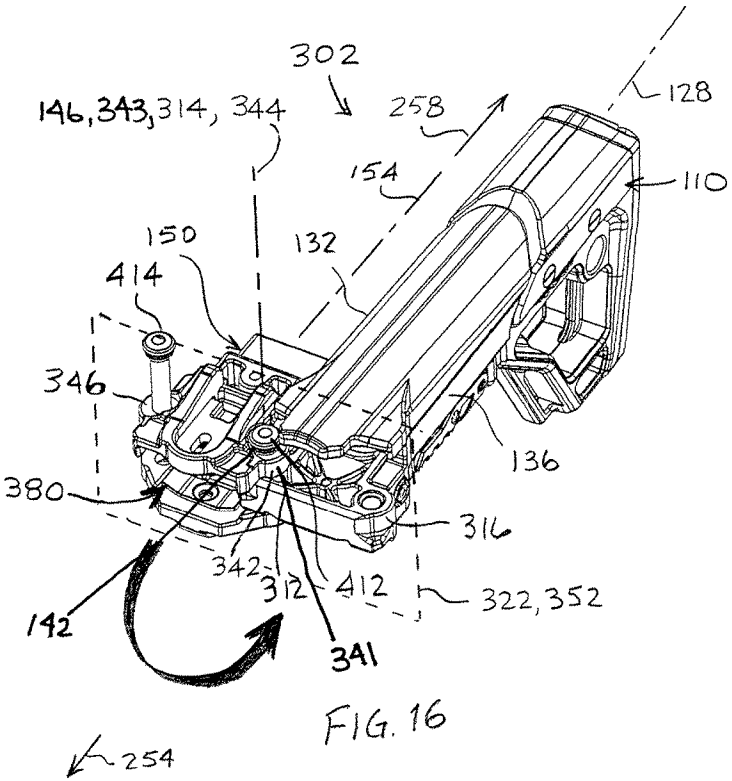
FIGS. 15 and 16 are perspective views of the configuration of the adjustable, foldable stock from the battery configuration of FIG. 2 to the first folded configuration of FIG. 7 according to an embodiment of the disclosure.
Figure 15:
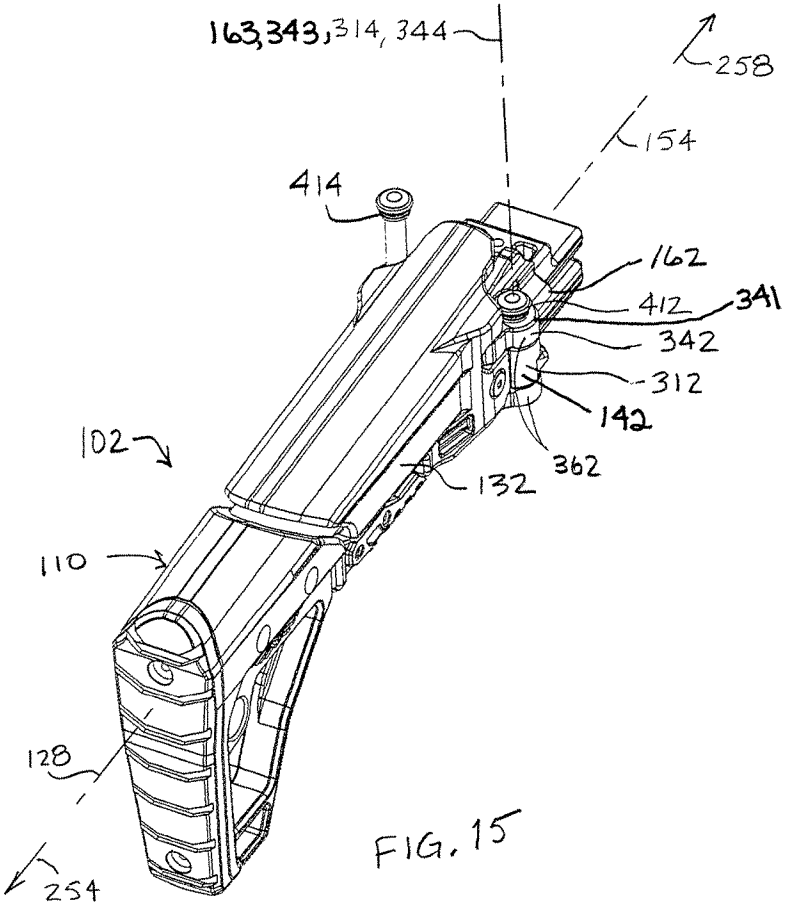

Referring to FIGS. 15 and 16, configuration of the adjustable folding stock 102 for the first folded configuration 302 of FIG. 7 is depicted in an embodiment of the disclosure. Starting from the battery configuration 104 of FIGS. 2 and 14, the second mounting pin 414 is fully retracted (FIG. 15) to release the second pivot assembly 144 (i.e., the second eye 316) of the mounting fitment 210 from the second pin receiving structure 345 (i.e., fourth eye 346) of the adaptor 150. The adaptor 150 remains coupled to the stock assembly 110 with the first mounting pin 412 disposed in the first pivot assembly 142 and the first pin receiving structure 341 (i.e., the first eye 312 and the third eye 342), so that the first pivot axis 146 remains aligned with the first receiving axis 343. In this configuration, the first mounting pin 412 serves as a pivot about the substantially concentric first pivot axis 142 and the first receiving axis 343, and about which the stock assembly 110 can rotate. The stock assembly 110 is then rotated into the first folded configuration 302, with the first side 132 of the stock assembly 110 being adjacent to the first side 162 of the adaptor 150. In some embodiments, the first free end 384 of the bow spring 380 clips into the first notch 326 disposed on the first side 132 of the stock assembly 110 to secure the folding stock assembly 110 in the first folded configuration 302.

Figure 18:
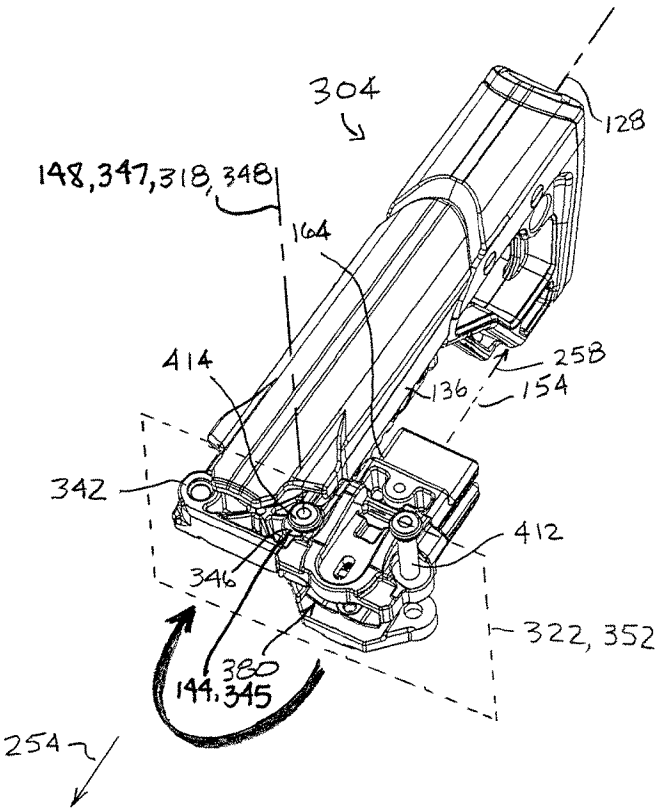
FIGS. 17 and 18 are perspective views of the configuration of the adjustable, foldable stock from the battery configuration of FIG. 2 to the second folded configuration of FIG. 8 according to an embodiment of the disclosure.
Figure 17:
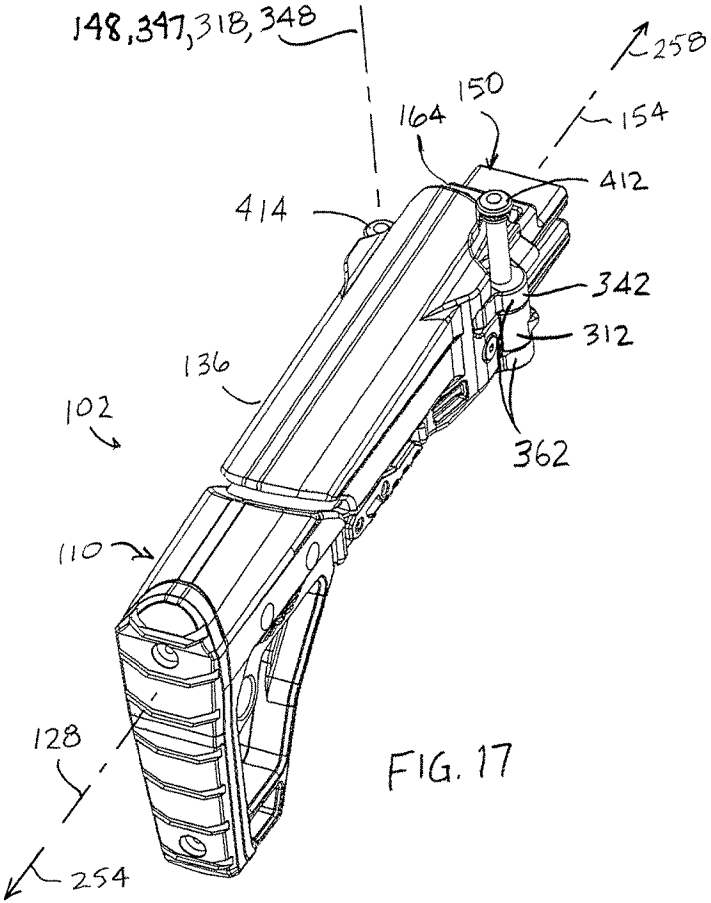

Referring to FIGS. 17 and 18, configuration of the adjustable folding stock 102 for the second folded configuration 304 of FIG. 8 is depicted in an embodiment of the disclosure. Starting from the battery configuration 104 of FIGS. 2 and 14, the first mounting pin 412 is fully retracted (FIG. 17) to release the first pivot assembly 142 (i.e., the first eye 312) of the mounting fitment 210 from the first pin receiving structure 341 (i.e., the third eye 342) of the adaptor 150. The adaptor 150 remains coupled to the stock assembly 110 with the second mounting pin 414 disposed in the second pivot assembly 144 and the second pin receiving structure 345 (i.e., the second eye 316 and the fourth eye 346), so that the second pivot axis 148 remains aligned with the second receiving axis 347. In this configuration, the second mounting pin 414 serves as a pivot about the substantially concentric second pivot axis 144 and second receiving axis 347, and about which the stock assembly 110 can rotate. The stock assembly 110 is then rotated into the second folded configuration 304, with the second side 136 of the stock assembly 110 being adjacent to the second side 164 of the adaptor 150. In some embodiments, the second free end 386 of the bow spring 380 clips into the second notch 328 disposed on the second side 136 of the stock assembly 110 to secure the folding stock assembly 110 in the second folded configuration 304.

In the depicted embodiments, the mounting axis 154 is parallel to the stock axis 128 when the first or second folded configuration 304. In some embodiments, the adaptor mounting plane 352 is co-planar with the stock mounting plane 322 of the stock assembly 110 when in either one or both of the first and second folded configurations 302, 304.

For clarity, the depictions of FIGS. 13 through 18 do not include the receiver 126. However, the assembly, configuration, and operations described above can be performed with the receiver 126 mounted to the adaptor 150. Also, in various embodiments, the folding stock 102 is provided as a kit for retrofitting to the receiver 126. Instructions for use of the folding stock 102 may be provided with the kit, the instructions being based on the description above attendant to FIGS. 13 through 18. In some embodiments, the instructions are provided on a tangible, non-transitory medium, such as written instructions on paper, or a medium such as a hard drive, flash drive, or compact disk, suitable for display on an electronic device, such as a personal computer, digital tablet, or smart phone.

Figure 19:
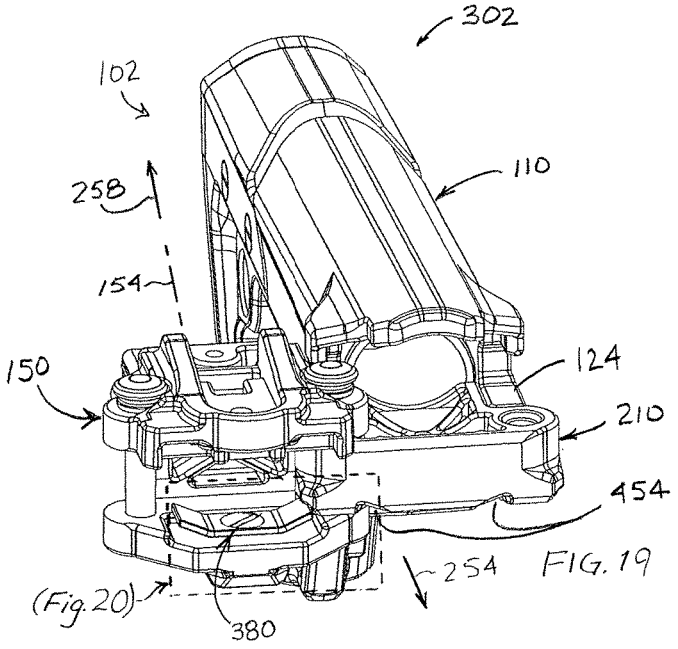
FIG. 19 is an upper rear perspective view of the adjustable, foldable stock in the first folded configuration of FIG. 7 according to an embodiment of the disclosure.
Figure 20:
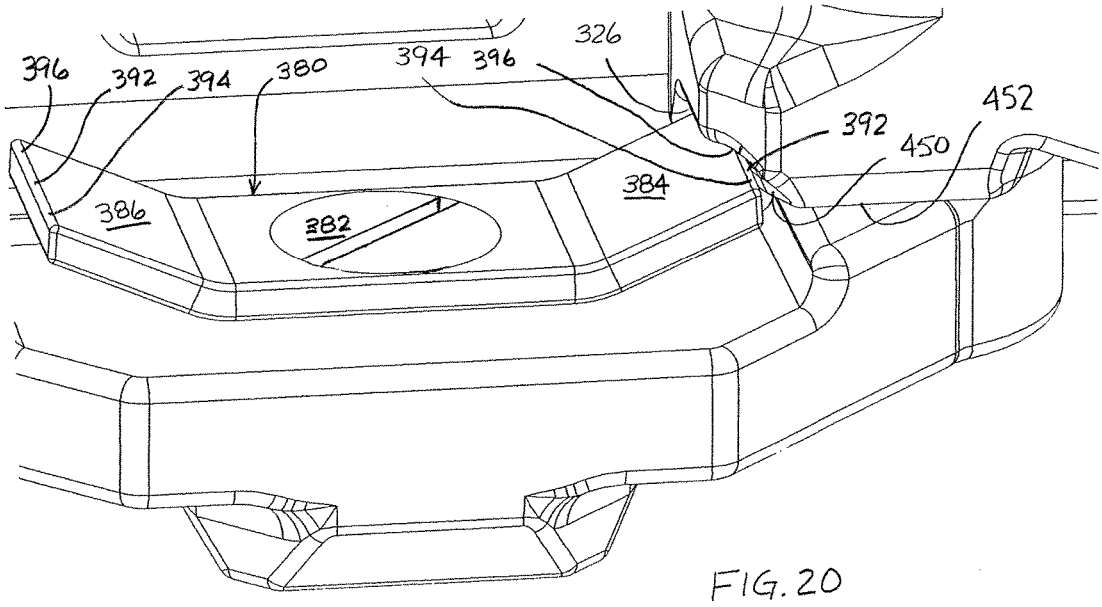
FIG. 20 is an enlarged, partial view of FIG. 19.

Referring to FIGS. 19 and 20, the bow spring 380 is depicted in a locked configuration in an embodiment of the disclosure. While engagement of the first free end 384 of the bow spring 380 with the first notch 326 of the stock assembly 110 while in the first folded configuration 302 is portrayed, the description of the operation of the bow spring 380 applies equally to either free end and notch combination. In the depicted embodiment, the distal portion 396 of the engagement edge 392 of the first free end 384 is engaged within the first notch 326, while the proximal portion 394 of the engagement edge 392 is exposed, protruding out of the first notch 326 in the proximal direction 254. A lead-in structure 450 is defined proximal to and adjacent the first notch 326, at the location where the proximal portion 394 of the engagement edge 392 projects out of the first notch 326.

Functionally, the lead-in structure 450 guides the deflection of the first free end 384 for release of the adjustable folding stock 102 from the folded configuration. The user grips the stock assembly 110 and rotates it toward the battery configuration 104 of FIGS. 2 and 14. The mechanical advantage provided by the length of the stock assembly 110 overcomes retention force provided by the bow spring 380 clipped within the first notch 326, causing the lead-in structure 450 rotate toward the exposed proximal portion 394 of the engagement edge 392. The first free end 384 of the bow spring 380 slides down the lead-in structure 450 as the lead-in structure 450 is rotated over the bow spring 380, causing the first free end 384 of the bow spring 380 to deflect downward. A lower surface 452 of the stock assembly 110 continues to slide over the first free end 384 as the stock assembly 110 is rotated into the battery configuration 104. When in the battery configuration 104, the free ends 384 and 386 of the bow spring 380 are aligned with relief recesses 454 on the receiver end portion 124 that accommodate the bow spring 380 in a non-deflected state.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

The invention claimed is:

1. A folding stock for a firearm, comprising:

a stock assembly including:

a butt end and a receiver end portion and defining a stock axis that extends from said butt end through said receiver end portion, said stock assembly including a first side that faces away from said stock axis and a second side that faces away from said stock axis in a direction opposite said first side of said stock assembly, said stock assembly including a first pivot assembly disposed on said first side and defining a first pivot axis that extends substantially parallel to said first side and in a direction that is substantially perpendicular to said stock axis, said stock assembly including a second pivot assembly disposed on said second side and defining a second pivot axis that extends substantially parallel to said second side and in a direction that is substantially perpendicular to said stock axis, each of said first pivot assembly and said second pivot assembly being configured to pivot said folding stock about a selected one of said first pivot axis and said second pivot axis;

an adaptor coupled to said receiver end portion of said stock assembly and for mounting to a receiver of the firearm, said adaptor defining a mounting axis that is parallel to a barrel axis of said firearm, said adaptor including a first side that faces away from said mounting axis and a second side that faces away from said mounting axis in a direction opposite said first side of said adaptor, wherein said adaptor includes a first pin receiving structure that defines a first receiving axis and a second pin receiving structure that defines a second receiving axis, said first pin receiving structure being disposed on said first side of said adaptor, said second pin receiving structure being disposed on said second side of said adaptor, said first pin receiving structure being configured to pivotally couple with said first pivot assembly, said second pin receiving structure being configured to pivotally couple with said second pivot assembly; and a bow spring mounted to said adaptor, said bow spring including a first free end and a second free end, wherein said first free end clips into a first notch defined on said first side of said stock assembly when in said first folded configuration to secure the folding stock assembly in said first folded configuration, and said second free end clips into a second notch defined on said second side of said stock assembly when in said second folded configuration to secure the folding stock in said second folded configuration, wherein:

in a battery configuration, said stock axis of said stock assembly is substantially parallel with said mounting axis of said adaptor, said first pivot axis is aligned with said first receiving axis, and said second pivot axis is aligned with said second receiving axis, said adaptor being coupled to said stock assembly with a first mounting pin disposed in said first pin receiving structure, and with a second mounting pin disposed in said second pin receiving structure;

in a first folded configuration, said first side of said stock assembly is adjacent said first side of said adaptor and said first pivot axis is aligned with said first receiving axis, said adaptor being coupled to said stock assembly with said first mounting pin disposed in said first pin receiving structure; and in a second folded configuration, said second side of said stock assembly is adjacent said second side of said adaptor and said second pivot axis is aligned with said second receiving axis, said adaptor being coupled to said stock assembly with said second mounting pin disposed in said second pin receiving structure.

2. The folding stock of claim 1, wherein said first pivot assembly includes structure defining a first eye centered about said first pivot axis and said second pivot assembly includes structure defining a second eye centered about said second pivot axis.

3. The folding stock of claim 1, wherein said first pin receiving structure defines a third eye concentric about said first receiving axis and said second pin receiving structure defines a fourth eye concentric about said second receiving axis.

4. The folding stock of claim 1, wherein said first pin receiving structure includes a trunnion structure concentric about said first receiving axis and said second pin receiving structure includes a trunnion structure concentric about said second receiving axis.

5. The folding stock of claim 1, wherein said first pivot axis and said second pivot axis are parallel to each other to define a stock mounting plane that passes through said receiver end portion of said stock assembly, and said first receiving axis and said second receiving axis are parallel to each other to define an adaptor mounting plane that passes through said adaptor.

6. The folding stock of claim 5, wherein said stock mounting plane is substantially perpendicular to said stock axis, and said adaptor mounting plane is perpendicular to said mounting axis.

7. The folding stock of claim 1, wherein said mounting axis is parallel to said stock axis when in at least one of said first folded configuration and said second folded configuration.

8. The folding stock of claim 1, wherein an adaptor mounting plane that passes through said adaptor is co-planar with a stock mounting plane that passes through said receiver end portion of said stock assembly when in at least one of said first folded configuration and said second folded configuration.

9. The folding stock of claim 1, wherein said first notch is distal to first eye axis and said second notch is distal to said second eye axis.

10. The folding stock of claim 1, wherein said receiver end portion includes a mounting piece fastened to said stock assembly, said mounting piece defining said first pivot axis and said second pivot axis.

11. A folding stock for a firearm, comprising a stock assembly including a butt end and a receiver end portion and defining a stock axis that extends from said butt end through said receiver end portion, said stock assembly including a first side that faces away from said stock axis and a second side that faces away from said stock axis in a direction opposite said first side of said stock assembly, said stock assembly including a first pivot assembly disposed on said first side and defining a first pivot axis that extends substantially parallel to said first side and in a direction that is substantially perpendicular to said stock axis, said stock assembly including a second pivot assembly disposed on said second side and defining a second pivot axis that extends substantially parallel to said second side and in a direction that is substantially perpendicular to said stock axis, each of said first pivot assembly and said second pivot assembly being configured to pivot said folding stock about a selected one of said first pivot axis and said second pivot axis, wherein said stock assembly includes:

a proximal stock subassembly including said butt end and a proximal stock housing, an adjustment tube fixedly attached to said proximal stock housing, said adjustment tube defining an adjustment axis that extends distally from said proximal stock subassembly, said adjustment tube defining a plurality of apertures, each aperture facing in a direction perpendicular to said adjustment axis;

a distal stock subassembly, including a distal stock housing that defines an internal passageway, said adjustment tube being slidably engaged within said internal passageway, and a retractable set pin coupled to said distal stock housing and arranged for selectively engaging any one of said plurality of apertures of said adjustment tube to releasably secure said proximal stock subassembly in a fixed relationship with said distal stock subassembly; and a biasing spring disposed between said proximal stock subassembly and said distal stock subassembly, said biasing spring exerting a biasing force parallel to said adjustment axis in a proximal direction on said proximal stock subassembly.

12. The folding stock of claim 11, wherein said adjustment tube includes a cylindrical portion.

13. The folding stock of claim 12, wherein said adjustment tube includes a rail portion, said plurality of apertures being defined in said rail portion.

14. The folding stock of claim 11, comprising a lever pivotally mounted to said distal stock housing and coupled to said retractable set pin for selectively engaging and disengaging said retractable set pin from said any one of said plurality of apertures.

* * * * *